US008577260B2

(12) United States Patent
Takahashi

(10) Patent No.: US 8,577,260 B2
(45) Date of Patent: Nov. 5, 2013

(54) FIXING APPARATUS AND IMAGE FORMING APPARATUS

(75) Inventor: Hironori Takahashi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 315 days.

(21) Appl. No.: 13/035,609

(22) Filed: Feb. 25, 2011

(65) Prior Publication Data

US 2011/0243607 A1 Oct. 6, 2011

(30) Foreign Application Priority Data

Mar. 30, 2010 (JP) ..... 2010-077796

(51) Int. Cl.
*G03G 15/20* (2006.01)

(52) U.S. Cl.
USPC ..... 399/122; 399/113; 399/320

(58) Field of Classification Search
USPC ..... 399/113, 122, 320
See application file for complete search history.

(56) References Cited

U.S. PATENT DOCUMENTS

2005/0031376 A1* 2/2005 Suzuki ..... 399/122
2007/0014600 A1* 1/2007 Ishii et al. ..... 399/328

FOREIGN PATENT DOCUMENTS

JP H08-272260 A 10/1996
JP 2007-086453 A 4/2007
JP 2007-206276 A 8/2007
JP 2007-320689 A 12/2007
JP 2008-134487 A 6/2008
JP 2008-137754 6/2008

OTHER PUBLICATIONS

Notice of Reasons for Rejection issued on May 15, 2012 to Japanese Application No. 2010-077796.

* cited by examiner

*Primary Examiner* — Ryan Walsh
(74) *Attorney, Agent, or Firm* — Knobbe Martens Olson & Bear LLP

(57) ABSTRACT

A fixing apparatus includes: a heating rotator, a pressurizing rotator and a fixing housing. The heating rotator is configured to be rotatable about a first rotational axis and has a peripheral surface heated by a heat source provided inside or outside of the heating rotator. The pressurizing rotator is configured to be rotatable about a second rotational axis parallel to the first rotational axis. The pressurizing rotator forms a fixing nip in conjunction with the heating rotator. The fixing housing is configured to accommodate the heating rotator and the pressurizing rotator. The heating rotator, the pressurizing rotator and the fixing housing form a fixing rotator unit. The fixing rotator unit is configured to be withdrawable from an apparatus main body of an image forming apparatus and such that the peripheral surface of the heating rotator is exposed when the fixing rotator unit is withdrawn from the apparatus main body.

9 Claims, 14 Drawing Sheets

FIXING APPARATUS AND IMAGE FORMING APPARATUS

This application is based on and claims the benefit of priority from Japanese Patent Application No. 2010-077796, filed on 30 Mar. 2010, the content of which is incorporated herein by reference.

BACKGROUND OF THE INVENTION

1. Field of the Invention

The present invention relates to a fixing apparatus and an image forming apparatus including the same.

2. Related Art

There are image forming apparatuses such as a copy machine, a printer, a facsimile machine and a multi-functional printer as apparatuses for forming (printing) an image on paper of a transfer object. Such an image forming apparatus forms an image on the paper by sequentially performing: an exposure step that forms an electrostatic latent image on a surface of a photoreceptor drum as the image supporting unit by irradiating the surface of the photoreceptor drum with laser light; a development step that develops an image by depositing toner on the electrostatic latent image formed on the surface of the photoreceptor drum; an image transfer step that transfers a toner image formed of the toner deposited on the surface of the photoreceptor drum to the paper; and a fixation step that fixes the toner image transferred to the paper onto the paper.

In the fixation step among the abovementioned steps, the toner needs to be fused in order to fix the toner image transferred to the paper. As a fixing apparatus performing the fixation step, a fixing apparatus has been conventionally used, which includes a heating rotator such as a heating roller, a pressurizing rotator such as a pressurizing roller and a heating mechanism for heating the heating rotator. Such a fixing apparatus pushes the pressurizing rotator against the heating rotator in order to form a fixing nip between the heating rotator and the pressurizing rotator and maintains a predetermined nip pressure in the fixing nip. The paper is fed into the fixing nip, so that the toner transferred to the paper is fused, pressurized and fixed onto the paper.

Generally, the fixing apparatus is provided with a separating member for separating a sheet of paper having passed through the fixing nip from a peripheral surface of the heating rotator. Introduction of such a separating member prevents an occurrence of a paper jam. On the other hand, it is likely that the heating rotator suffers from damage, such as streaks on a surface of the heating rotator, which are created by a tip of the separating member that comes in contact with the peripheral surface of the heating rotator. Under this circumstance, a technique is proposed, which regulates (limits) movement of the tip of the separating member toward the peripheral surface of the heating rotator, such that a minuscule gap is maintained between the tip of the separating member and the peripheral surface of the heating rotator.

However, since the minuscule gap is maintained between the tip of the separating member and the peripheral surface of the heating rotator in the abovementioned fixing apparatus, it is likely that an edge of a sheet of paper having passed through the fixing nip enters the gap. When the edge of the sheet of paper enters the gap, the sheet of paper tends to stick firmly to the peripheral surface of the heating rotator. In such a case, it is difficult to troubleshoot jamming of the paper stuck to the peripheral surface of the heating rotator.

Therefore, a fixing apparatus is in high demand, which enables removing of a sheet of paper stuck to the peripheral surface of the heating rotator.

SUMMARY OF THE INVENTION

The present invention relates to a fixing apparatus that fixes a toner image on a transfer object onto which the toner image is transferred. The apparatus includes: a heating rotator, a pressurizing rotator and a fixing housing. The heating rotator is configured to be rotatable about a first rotational axis and has a peripheral surface that is heated by a heat source provided inside or outside the heating rotator. The pressurizing rotator is configured to be rotatable about a second rotational axis that is parallel to the first rotational axis. The pressurizing rotator forms a fixing nip in conjunction with the heating rotator. The fixing housing is configured to accommodate the heating rotator and the pressurizing rotator. The heating rotator, the pressurizing rotator and the fixing housing form a fixing rotator unit. The fixing rotator unit is configured to be withdrawable from an apparatus main body of an image forming apparatus and to be such that the peripheral surface of the heating rotator is exposed when the fixing rotator unit is withdrawn from the apparatus main body.

The present invention provides a fixing apparatus that enables easy and handy jam troubleshooting of a transfer object stuck to the peripheral surface of the heating rotator.

In addition, the present invention provides an image forming apparatus including the abovementioned fixing apparatus.

DETAILED DESCRIPTION OF THE INVENTION

Embodiments of the present invention are described hereinafter with reference to the drawings.

Figure 1:
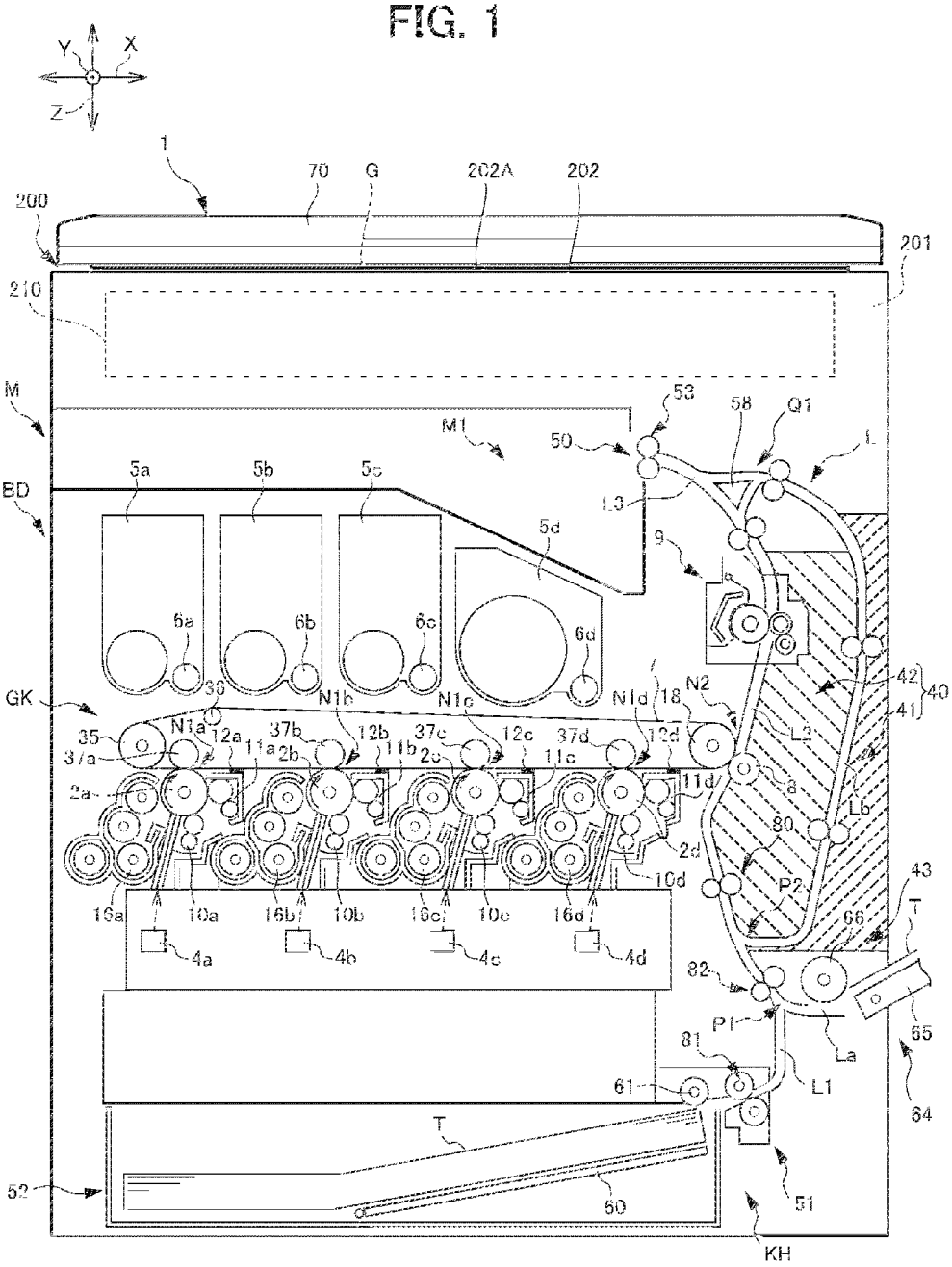
FIG. 1 is a front view illustrating an arrangement of components of a copy machine 1 of an embodiment of the present invention.

An overall structure of a copy machine 1 as an embodiment of an image forming apparatus according to the present invention will be described referring to FIG. 1. FIG. 1 is a front view illustrating an arrangement of components of a copy machine 1 of an embodiment of the present invention.

Hereinafter, when viewed by a user standing in front of the copy machine 1, a horizontal direction indicates a direction of an arrow X, a depth direction indicates a direction of an arrow Y, and a vertical direction indicates a direction of an arrow Z. The horizontal direction X is also a main scanning direction of an image reading device 200 to be described later. The depth direction Y is also a sub-scanning direction of the image reading device 200.

As shown in FIG. 1, the copy machine 1 as an image forming apparatus includes an image reading device 200 and an apparatus main body M. The image reading device 200 is disposed in an upper portion of the copy machine 1 in the vertical direction Z. The apparatus main body M is disposed in a lower portion of the copy machine 1 in the vertical direction Z, and forms a toner image on a sheet of paper T, which is a transfer object, based on image information from the image reading device 200.

The image reading device 200 includes a cover 70 and a reader unit 201 that reads an image from an original G.

The cover 70 is connected with the reader unit 201 by a connecting part (not shown) so as to be openable and closable. The cover 70 has a function to protect a reading surface 202A (to be described later).

The reader unit 201 includes the reading surface 202A and a carriage 210 that is disposed inside the reader unit 201 and moves in a direction parallel to the reading surface 202A.

The reading surface 202A is formed along an upper face of a contact glass 202 on which the original G is placed.

The carriage 210 includes a plurality of mirrors forming light paths (not illustrated), an imaging lens (not illustrated), a CCD (not illustrated) as a reading means, and a CCD board (not illustrated). The CCD board performs a predetermined process for image data read by the CCD and outputs the image data to the apparatus main body M. The carriage 210 is movable at a constant speed in the sub-scanning direction Y orthogonal to the main scanning direction X. As a result, an image of the original G placed on the reading surface 202A is read.

The apparatus main body M includes: an image forming unit GK that forms a predetermined image on a sheet of paper T based on image information; and a paper feeding/discharging unit KH that feeds the sheet of paper T to the image forming unit GK and discharges the sheet of paper T on which an image is formed.

The external shape of the apparatus main body M is composed of a cabinet BD as a housing.

As shown in FIG. 1, the image forming unit GK includes: photoreceptor drums 2*a*, 2*b*, 2*c*, and 2*d* as image supporting bodies (photoreceptors); charging parts 10*a*, 10*b*, 10*c*, and 10*d*; laser scanner units 4*a*, 4*b*, 4*c*, and 4*d* as exposure units; developing units 16*a*, 16*b*, 16*c*, and 16*d*; toner cartridges 5*a*, 5*b*, 5*c*, and 5*d*; toner feeding parts 6*a*, 6*b*, 6*c*, and 6*d*; drum cleaning parts 11*a*, 11*b*, 11*c*, and 11*d*; static eliminators 12*a*, 12*b*, 12*c*, and 12*d*; an intermediate image transfer belt 7; primary image transfer rollers 37*a*, 37*b*, 37*c*, and 37*d*; a secondary image transfer roller 8; an opposing roller 18; and the fixing apparatus 9.

As shown in FIG. 1, the paper feeding/discharging unit KH includes a paper feeding cassette 52, a manual feeding unit 64, a paper feed path L for a sheet of paper T, a pair of resist rollers 80, a plurality of rollers or roller pairs, and an discharging part 50. It should be noted that, as will be described later, the paper feed path L is an assembly of a first paper feed path L1, a second paper feed path L2, a third paper feed path L3, a manual paper feed path La, and a reverse paper feed path Lb.

Components of the image forming unit GK and the paper feeding/discharging unit KH will be described in detail hereinafter.

First, a description is provided for the image forming unit GK.

In the image forming unit GK, charging by the charging parts 10*a*, 10*b*, 10*c* and 10*d*, exposure by the laser scanner units 4*a*, 4*b*, 4*c* and 4*d*, development by the developing units 16*a*, 16*b*, 16*c* and 16*d*, primary image transfer by the intermediate image transfer belt 7 and the primary image transfer rollers 37*a*, 37*b*, 37*c* and 37*d*, static elimination by the static eliminators 12*a*, 12*b*, 12*c* and 12*d*, and cleaning by the drum cleaning parts 11*a*, 11*b*, 11*c* and 11*d*, are performed sequentially on surfaces of the photoreceptor drums 2*a*, 2*b*, 2*c* and 2*d*, from an upstream side to a downstream side.

In addition, secondary image transfer by the intermediate image transfer belt 7, the secondary image transfer roller 8 and the opposing roller 18, and fixation by the fixing apparatus 9 are performed in the image forming unit GK.

Each of the photoreceptor drums 2*a*, 2*b*, 2*c*, and 2*d* is composed of a cylindrically shaped member and functions as a photoreceptor or an image supporting unit. Each of the photoreceptor drums 2*a*, 2*b*, 2*c*, and 2*d* is disposed rotatable in a direction of an arrow, about an axis that extends in a direction orthogonal to a direction of movement of the intermediate image transfer belt 7. An electrostatic latent image is formed on a surface of each of the photoreceptor drums 2*a*, 2*b*, 2*c*, and 2*d*.

Each of the charging parts 10*a*, 10*b*, 10*c*, and 10*d* is disposed to face a surface of each of the photoreceptor drums 2*a*, 2*b*, 2*c*, and 2*d*. Each of the charging parts 10*a*, 10*b*, 10*c*, and 10*d* negatively (negative polarity) or positively (positive polarity) charges a surface of each of the photoreceptor drums 2*a*, 2*b*, 2*c*, and 2*d* uniformly.

Each of the laser scanner units 4*a*, 4*b*, 4*c*, and 4*d*, which functions as an exposure unit, is disposed to be spaced apart from a surface of each of the photoreceptor drums 2*a*, 2*b*, 2*c*, and 2*d*. Each of the laser scanner units 4*a*, 4*b*, 4*c*, and 4*d* includes a laser light source, a polygonal mirror, a polygonal mirror driving motor and the like, which are not illustrated.

Each of the laser scanner units 4*a*, 4*b*, 4*c*, and 4*d* scans and exposes a surface of each of the photoreceptor drums 2*a*, 2*b*, 2*c*, and 2*d*, based on image information input from the reader unit 201 or an external device such as a PC (personal computer). An electric charge of an exposed part of the surface of each of the photoreceptor drums 2*a*, 2*b*, 2*c*, and 2*d* is removed, which are scanned and exposed by the laser scanner units 4*a*, 4*b*, 4*c*, and 4*d*, respectively. In this way, an electrostatic latent image is formed on the surface of each of the photoreceptor drums 2*a*, 2*b*, 2*c*, and 2*d*.

The developing units 16*a*, 16*b*, 16*c*, and 16*d* are disposed to correspond to the photoreceptor drums 2*a*, 2*b*, 2*c*, and 2*d*, respectively, facing corresponding surfaces of the photoreceptor drums 2*a*, 2*b*, 2*c*, and 2*d*. Each of the developing units 16*a*, 16*b*, 16*c*, and 16*d* forms a color toner image on a surface of each of the photoreceptor drums 2*a*, 2*b*, 2*c*, and 2*d* by depositing toners of various colors on an electrostatic latent image formed on the surface of each of the photoreceptor drums 2*a*, 2*b*, 2*c*, and 2*d*. The developing units 16*a*, 16*b*, 16*c*, and 16*d* correspond to four colors of yellow, cyan, magenta, and black, respectively. Each of the developing units 16*a*, 16*b*, 16*c*, and 16*d* includes a developing roller disposed to face a surface of each of the photoreceptor drums 2*a*, 2*b*, 2*c*, and 2*d* and a agitating roller for agitating toner.

The toner cartridges 5*a*, 5*b*, 5*c*, and 5*d* are provided corresponding to the developing units 16*a*, 16*b*, 16*c*, and 16*d*, respectively, and store the toners of different colors that are supplied to the developing units 16*a*, 16*b*, 16*c*, and 16*d*, respectively. The toner cartridges 5*a*, 5*b*, 5*c*, and 5*d* store toners of yellow, cyan, magenta, and black respectively.

The toner feeding parts 6*a*, 6*b*, 6*c*, and 6*d* are provided to correspond to the toner cartridges 5*a*, 5*b*, 5*c*, and 5*d* and the developing units 16*a*, 16*b*, 16*c*, and 16*d*, respectively. The toner feeding parts 6*a*, 6*b*, 6*c*, and 6*d* supply the toners of the respective colors stored in the toner cartridges 5*a*, 5*b*, 5*c*, and 5*d* to the developing units 16*a*, 16*b*, 16*c*, and 16*d*, respectively. The toner feeding apparatuses 6*a*, 6*b*, 6*c*, and 6*d* are connected with the developing units 16*a*, 16*b*, 16*c*, and 16*d*, respectively, via toner feeding paths (not illustrated).

Toner images of respective colors formed on the photoreceptor drums 2*a*, 2*b*, 2*c*, and 2*d* undergo primary transfer in sequence onto the intermediate image transfer belt 7. The intermediate image transfer belt 7 goes around a driven roller 35, the opposing roller 18 of a driving roller, a tension roller 36 and the like. Since the tension roller 36 biases the intermediate image transfer belt 7 from inside to outside, a predetermined tension is applied to the intermediate image transfer belt 7.

The primary image transfer rollers 37*a*, 37*b*, 37*c*, and 37*d* are disposed opposite to the photoreceptor drums 2*a*, 2*b*, 2*c* and 2*d*, respectively, interposing the intermediate image transfer belt 7 with the photoreceptor drums 2*a*, 2*b*, 2*c*, and 2*d*.

Parts of the intermediate image transfer belt 7 are sandwiched between the primary image transfer rollers 37*a*, 37*b*, 37*c*, and 37*d* and the photoreceptor drums 2*a*, 2*b*, 2*c*, and 2*d*. The sandwiched parts are pressed against surfaces of the photoreceptor drums 2*a*, 2*b*, 2*c*, and 2*d*. Primary image transfer nips N1*a*, N1*b*, N1*c*, and N1*d* are formed between the photoreceptor drums 2*a*, 2*b*, 2*c*, and 2*d* and the primary image transfer rollers 37*a*, 37*b*, 37*c*, and 37*d*, respectively. At the primary image transfer nips N1*a*, N1*b*, N1*c*, and N1*d*, toner images of the respective colors developed on the photoreceptor drums 2*a*, 2*b*, 2*c*, and 2*d* undergo primary transfer in sequence onto the intermediate image transfer belt 7. In this manner, a full-color toner image is formed on the intermediate image transfer belt 7.

A primary image transfer bias is applied to each of the primary image transfer rollers 37*a*, 37*b*, 37*c*, and 37*d* by a primary image transfer bias application part (not illustrated). Due to the primary image transfer bias, a toner image of each color formed on each of the photoreceptor drums 2*a*, 2*b*, 2*c*, and 2*d* is transferred onto the intermediate image transfer belt 7.

The static eliminators 12*a*, 12*b*, 12*c*, and 12*d* are disposed to face surfaces of the photoreceptor drums 2*a*, 2*b*, 2*c*, and 2*d*, respectively. The static eliminators 12*a*, 12*b*, 12*c*, and 12*d* each remove electricity (eliminate an electrical charge) from a surface of each of the photoreceptor drums 2*a*, 2*b*, 2*c*, and 2*d* after the primary image transfer, by irradiating light on the surface of each of the photoreceptor drums 2*a*, 2*b*, 2*c*, and 2*d*.

The drum cleaning parts 11*a*, 11*b*, 11*c*, and 11*d* are disposed to face the surfaces of the photoreceptor drums 2*a*, 2*b*, 2*c*, and 2*d*, respectively. The drum cleaning parts 11*a*, 11*b*, 11*c*, and 11*d* remove toner and attached matter remaining on the surfaces of the photoreceptor drums 2*a*, 2*b*, 2*c*, and 2*d*, respectively, and convey the removed toner to a collection mechanism such that the toner is collected.

The secondary image transfer roller 8 causes the full-color toner image, which has been primarily transferred to the intermediate image transfer belt 7, to be secondarily transferred to a sheet of paper T. A secondary image transfer bias is applied to the secondary image transfer roller 8 by a secondary image transfer bias application part (not illustrated). With a secondary image transfer bias being applied, the full-color toner image formed on the intermediate image transfer belt 7 is transferred to the sheet of paper T.

The secondary image transfer roller 8 comes into contact with and departs away from the intermediate image transfer belt 7 selectively. More specifically, the secondary image transfer roller 8 is configured to be movable between a contact position at which it is in contact with the intermediate image transfer belt 7 and a spaced position at which it is spaced apart from the intermediate image transfer belt 7. In particular, the secondary image transfer roller 8 is disposed at the contact position when it transfers the toner image that has been primarily transferred to the surface of the intermediate image transfer belt 7 onto the sheet of paper T. Under other circumstances it is disposed at the spaced position.

The opposing roller 18 is disposed opposite to the secondary image transfer roller 8 across the intermediate image transfer belt 7. A portion of the intermediate image transfer belt 7 is sandwiched between the secondary image transfer roller 8 and the opposing roller 18. The sheet of paper T is pressed against an outer surface (a surface to which the toner image is primarily transferred) of the intermediate image transfer belt 7. A secondary image transfer nip N2 is formed between the intermediate image transfer belt 7 and the secondary image transfer roller 8. At the secondary image transfer nip N2, the full-color toner image primarily transferred to the intermediate image transfer belt 7 is secondarily transferred to the paper T.

The fixing apparatus 9 fuses and pressurizes respective color toners forming the toner image that has been secondarily transferred to the sheet of paper T, such that the color toners are fixed on the sheet of paper T. The fixing apparatus 9 includes a heating rotator 9*a* that is heated by an external heating mechanism 410 (to be described later), and a pressurizing rotator 9*b*. The heating rotator 9*a* and the pressurizing rotator 9*b* sandwich and apply pressure to the sheet of paper T to which the toner image is secondarily transferred, and also feed the sheet of paper T. The sheet of paper T is fed while sandwiched between the heating rotator 9*a* and the pressurizing rotator 9*b*, so that the toner transferred to the sheet of paper is fused and pressurized to be fixed to the sheet of paper T. A configuration of the fixing apparatus 9 will be described later in detail.

Next, the paper feeding/discharging unit KH will be described.

As shown in FIG. 1, the paper feeding cassette 52 for housing sheets of paper T is disposed in a lower portion of the apparatus main body M. The paper feeding cassette 52 is configured to be manually drawn in a horizontal direction from a housing of the apparatus main body M. The paper feeding cassette 52 includes a paper tray 60 on which the sheets of paper T are placed. The paper feeding cassette 52 stores the sheets of paper T stacked on the paper tray 60. A sheet of paper T placed on the paper tray 60 is fed to the paper feed path L by a cassette feeding part 51 disposed in an end part of the paper feeding cassette 52 on a side of feeding the transfer object (at a right end portion of FIG. 1). The cassette feeding part 51 includes a double feed prevention mechanism including: a forward feed roller 61 for picking up a sheet of paper T on the paper tray 60; and a pair of paper feeding rollers 81 for feeding the sheet of paper T one at a time to the paper feed path L.

The manual feeding unit 64 is provided on a right lateral face (the right side in FIG. 1) of the apparatus main body M. The manual feeding unit 64 is provided in order to feed other sheets of paper T to the apparatus main body M, which are different in size and type from the sheets of paper T stored in the paper feeding cassette 52. The manual feeding unit 64 includes a manual feeding tray 65, which becomes a portion of a right lateral face of the apparatus main body M when the manual feeding unit 64 is closed, and a paper feeding roller 66. A lower end of the manual feeding tray 65 is rotatably attached in a vicinity of the paper feeding roller 66 (openable and closable). A sheet or sheets of paper T are placed on the manual feeding tray 65 while it is open. The paper feeding roller 66 feeds a sheet of paper T placed on the manual feeding tray 65 while it is open to the manual feeding path La.

The paper feed path L includes: the first paper feed path L1 from the cassette feeding part 51 to the secondary image transfer nip N2; the second paper feed path L2 from the secondary image transfer nip N2 to the fixing apparatus 9; the third paper feed path L3 from the fixing apparatus 9 to the discharging part 50; the manual paper feed path La that guides paper fed from the manual feeding unit 64 to the first paper feed path L1; and the reverse paper feed path Lb that reverses a sheet of paper T fed from downstream to upstream of the third paper feed path L3 and returns the sheet of paper T to the first paper feed path L1.

In addition, a first junction P1 and a second junction P2 are provided in the middle of the first paper feed path L1. A first branch part Q1 is provided in the middle of the third paper feed path L3.

The first junction P1 is where the manual paper feed path La joins the first paper feed path L1. The second junction P2 is where the reverse paper feed path Lb joins the first paper feed path L1.

The first branch part Q1 is where the reverse paper feed path Lb branches off from the third paper feed path L3.

A paper detection sensor (not illustrated) for detecting a sheet of paper T and the pair of resist rollers 80 are disposed in the middle of the first paper feed path L1 (more specifically, between the second junction P2 and the secondary image transfer roller 8). The paper detection sensor is disposed immediately before the pair of resist rollers 80 in a feed direction of a sheet of paper T (upstream of the feed direction). The pair of resist rollers 80 performs skew compensation of a sheet of paper T and timing adjustment with respect to formation of a toner image in the image forming unit GK. The pair of resist rollers 80 performs the abovementioned compensation and timing adjustment based on signal information detected by the paper detection sensor and feeds the sheet of paper T.

A pair of intermediate rollers 82 is disposed between the first junction P1 and the second junction P2 in the first paper feed path L1. The pair of intermediate rollers 82 is disposed downstream of a pair of paper feeding rollers 81. It sandwiches to feed a sheet of paper T, which is fed from the pair of paper feeding rollers 81, to the pair of resist rollers 80.

A reverse paper feed path Lb causes a surface (an unprinted surface) opposite to a surface having already been printed to face the intermediate image transfer belt 7, when duplex printing of a sheet of paper T is performed. The reverse paper feed path Lb reverses and returns the sheet of paper T, which is fed from the first branch part Q1 toward the discharging part 50, to the first paper feed path L1. Subsequently, the reverse paper feed path Lb feeds the sheet of paper T to upstream of the pair of resist rollers 80, which is disposed upstream of the secondary image transfer roller 8. At the secondary image transfer nip N2, a toner image is transferred to the unprinted surface of the sheet of paper T that has been reversed by the reverse paper feed path Lb.

A regulating member 58 is provided in the first branch part Q1. The regulating member 58 regulates a feed direction of the sheet of paper T, which is discharged from the fixing apparatus 9 and fed from upstream to downstream of the third paper feed path L3, in a direction toward the discharging part 50. The regulating member 58 regulates the feed direction of the sheet of paper T, which is fed from the discharging part 50 from downstream to upstream of the third paper feed path L3, to a direction toward the reverse paper feed path Lb.

A discharging part 50 is provided at an end part of the third paper feed path L3. The discharging part 50 is disposed in an upper portion of the apparatus main body M. The discharging part 50 has an opening toward a left lateral face of the apparatus main body M (left side in FIG. 1). The discharging part 50 discharges the sheet of paper T outside the apparatus main body M. The discharging part 50 includes a pair of discharging rollers 53. The pair of discharging rollers 53 discharges the sheet of paper T, which is fed in the third paper feed path L3 from upstream to downstream, outside the apparatus main body M. In addition, in a case of duplex printing, the pair of discharging rollers 53 reverses the feed direction of the sheet of paper T at the discharging part 50 and feeds the sheet of paper T upstream of the third paper feed path L3.

A discharged paper collection part M1 is provided on a side of the opening of the discharging part 50. The discharged paper collection part M1 is provided on an upper face (outer face) of the apparatus main body M. The discharged paper collection part M1 is where the upper face of the apparatus main body M is recessed downward. A bottom face of the discharged paper collection part M1 constitutes a part of the upper face of the apparatus main body M. Sheets of paper T, on which predetermined toner images are formed and which are discharged from the discharging part 50, are stacked and collected in the discharged paper collection part M1.

It should be noted that a sensor for detecting the transfer object is disposed at a predetermined position of each paper feed path.

Next, a setup is briefly described, which eliminates paper jams in main paper feed paths L1 to L3 (the first paper feed path L1, the second paper feed path L2, and the third paper feed path L3 are also collectively referred to as "main paper feed paths" hereinafter) and in the reverse paper feed path Lb.

As shown in FIG. 1, on a right lateral face side of the apparatus main body M (right side in FIG. 1), the first to third paper feed paths L1 to L3 and the reverse paper feed path Lb typically extend in parallel in a vertical direction. On a right lateral face side of the apparatus main body M (right side in FIG. 1), a cover unit 40 is provided so as to constitute a portion of the lateral face of the apparatus main body M. A lower end portion of the cover unit 40 is connected with the apparatus main body M via a fulcrum shaft 43. The fulcrum shaft 43 is disposed such that an axial direction thereof is along a direction intersecting the main paper feed paths L1 to L3 and the reverse paper feed path Lb (the direction Y). The cover unit 40 is configured to be rotatable about the fulcrum shaft 43 between a closed position (shown in FIG. 1) and an opened position (shown in FIG. 2).

The cover unit 40 is composed of a first cover part 41 and a second cover part 42 that are each connected rotatably with the apparatus main body M by the fulcrum shaft 43. The first cover part 41 is positioned more externally (lateral face side) than the second cover part 42 with respect to the apparatus main body M. It should be noted that, in FIG. 1, a part hatched with falling diagonal broken lines from top right to bottom left indicates the first cover part 41, and a part hatched with falling diagonal broken lines from top left to bottom right indicates the second cover part 42.

When the cover unit 40 is in a closed position, an outer oriented face of the first cover part 41 constitutes a portion of an outer face (lateral face) of the apparatus main body M.

In addition, when the cover unit 40 is in the closed position, an inner oriented face (facing inside the apparatus main body M) of the second cover part 42 constitutes a portion of the main paper feed paths L1 to L3.

Furthermore, when the cover unit 40 is in the closed position, an inner oriented face of the first cover part 41 and an outer oriented face of the second cover part 42 constitute at least a portion of the reverse paper feed path Lb. In other words, the reverse paper feed path Lb is formed between the first cover part 41 and the second cover part 42.

Figure 2:
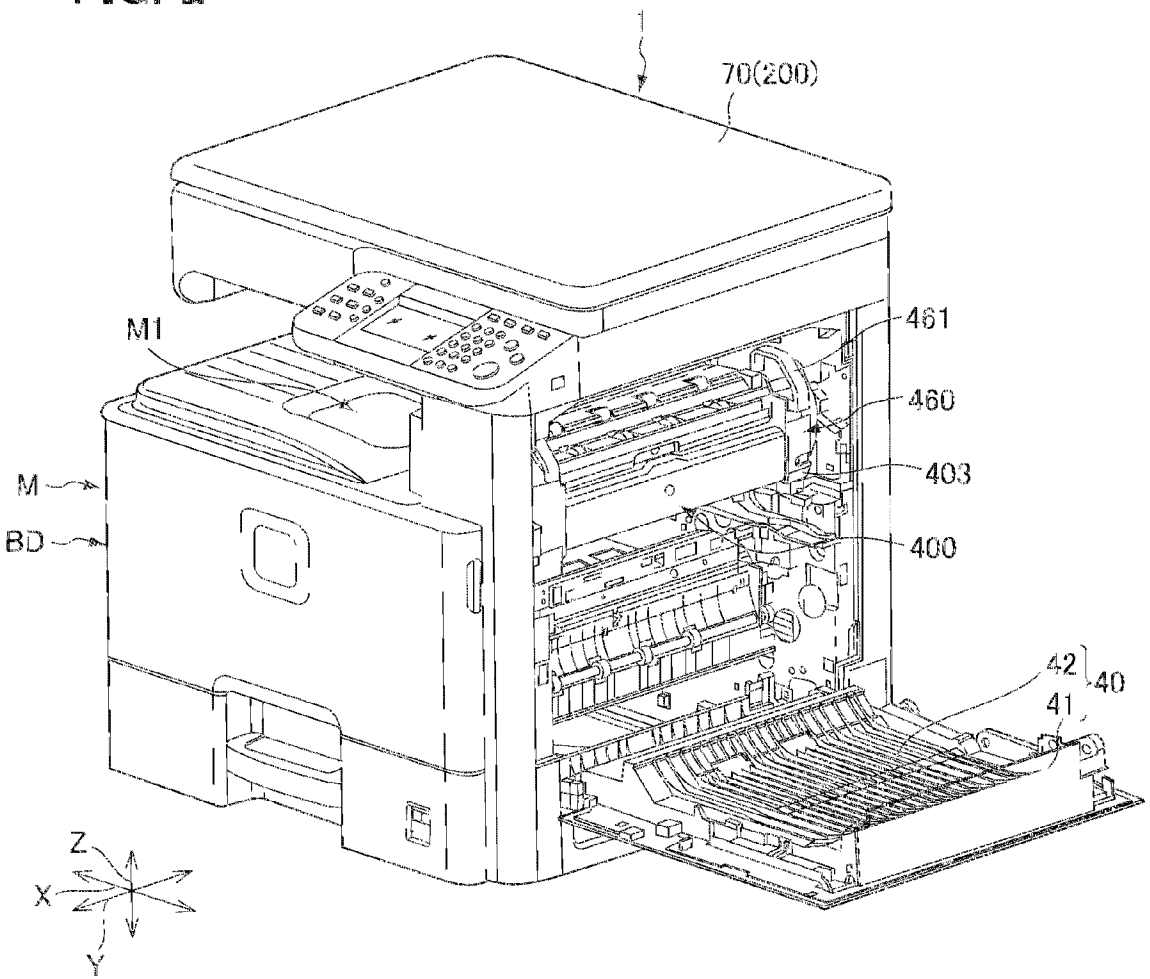
FIG. 2 is a perspective view of a fixing apparatus 9 of the copy machine 1 of the embodiment of the present invention, viewed externally from an X direction in a state in which a cover unit 40 is open.

Since the copy machine 1 according to the present embodiment is provided with the cover unit 40 described above, it is possible to troubleshoot a sheet of paper T jammed in the first to third paper feed paths L1 to L3 by rotating the cover unit 40 from the closed position shown in FIG. 1 to the opened position shown in FIG. 2 so as to open the first to third paper feed paths L1 to L3, when a paper jam occurs in the first to third paper feed paths L1 to L3. On the other hand, in a case where a paper jam occurs in the reverse paper feed path Lb, it is possible to troubleshoot a sheet of paper T jammed in the reverse paper feed path Lb by rotating the cover unit 40 to the opened position and then rotating the second cover part 42 about the fulcrum shaft 43 toward inside the apparatus main body M (left side in FIG. 1) so as to open the reverse paper feed path Lb.

Figure 3:
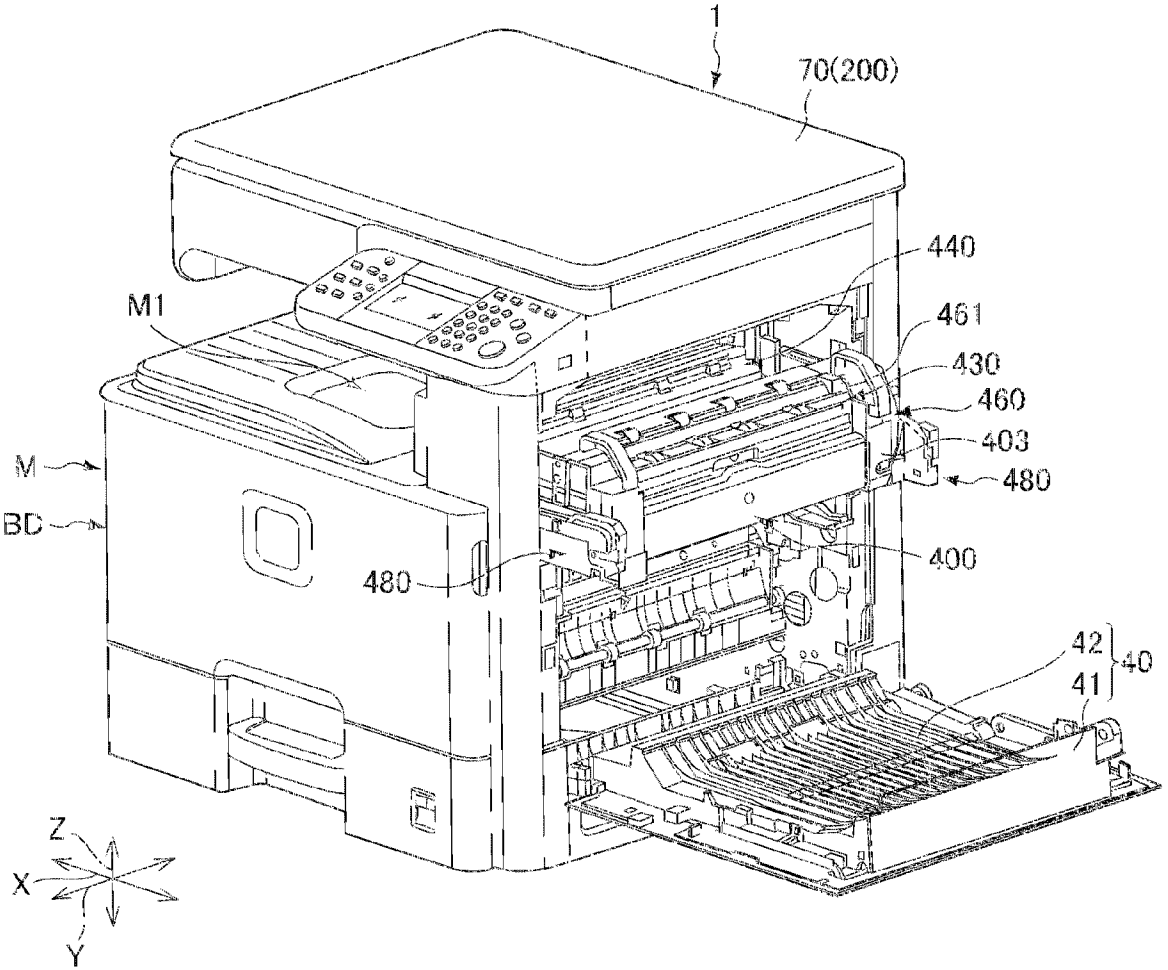
FIG. 3 is a perspective view showing a fixing rotator unit 460 withdrawn from an apparatus main body M, viewed externally from the X direction, compared with FIG. 2 in which the fixing rotator unit 460 is inside the apparatus main body M.
Figure 4:
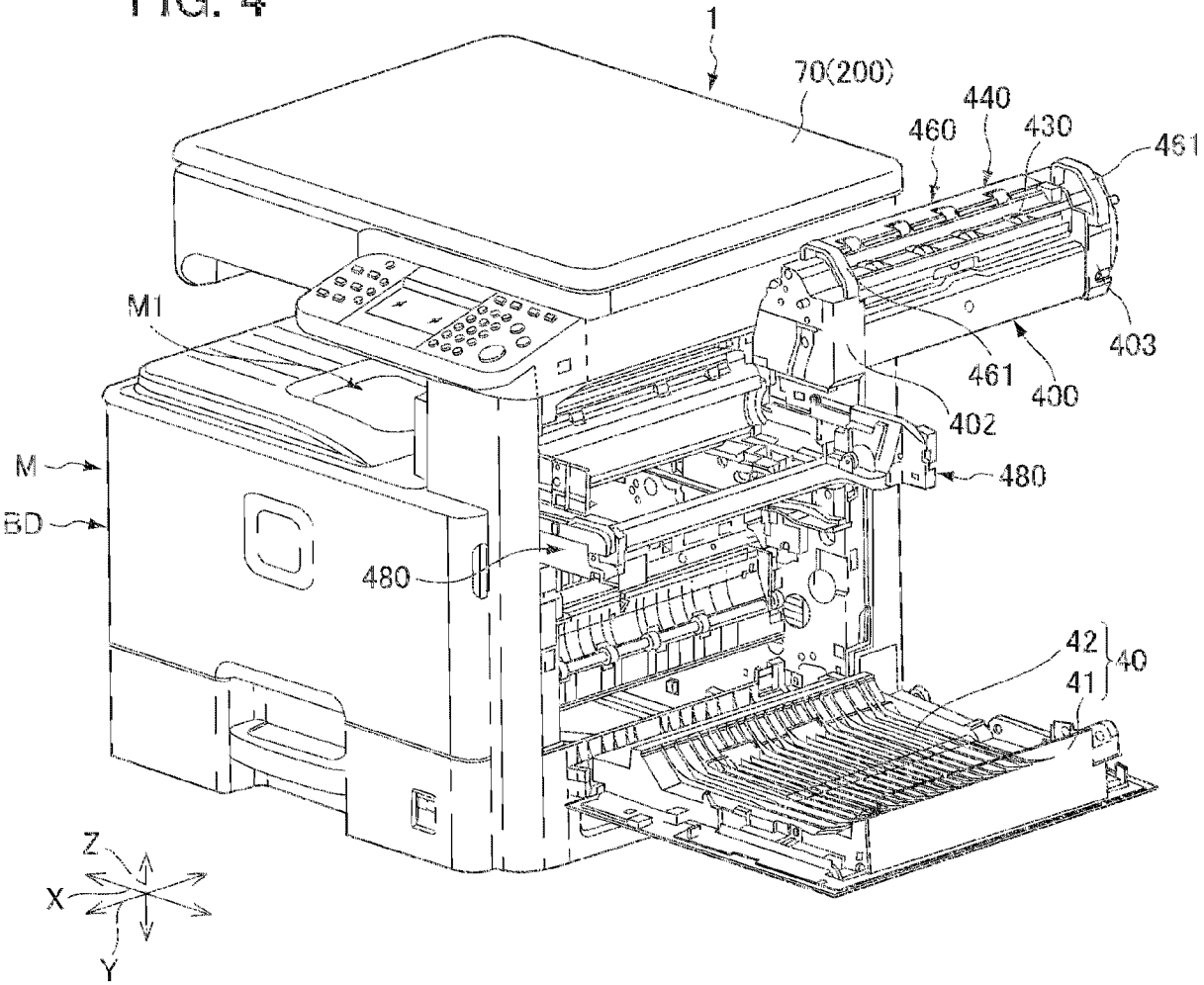
FIG. 4 is a perspective view showing the fixing rotator unit 460 removed from a rail part 480, viewed externally from the X direction, compared with FIG. 3.

Next, a configuration of the fixing apparatus 9, which is a distinguishing feature of the copy machine 1 according to the present embodiment, is described in detail. FIG. 2 is a perspective view of the fixing apparatus 9 of the copy machine 1 according to the embodiment of the present invention, viewed from outside in the X direction while the cover unit 40 is open. FIG. 3 is a perspective view showing the fixing rotator unit 460 being withdrawn from the apparatus main body M compared with FIG. 2, viewed from outside in the X direction. FIG. 4 is a perspective view the fixing rotator unit 460 being removed from the rail part 480 compared with FIG. 3, viewed from outside in the X direction.

Figure 5:
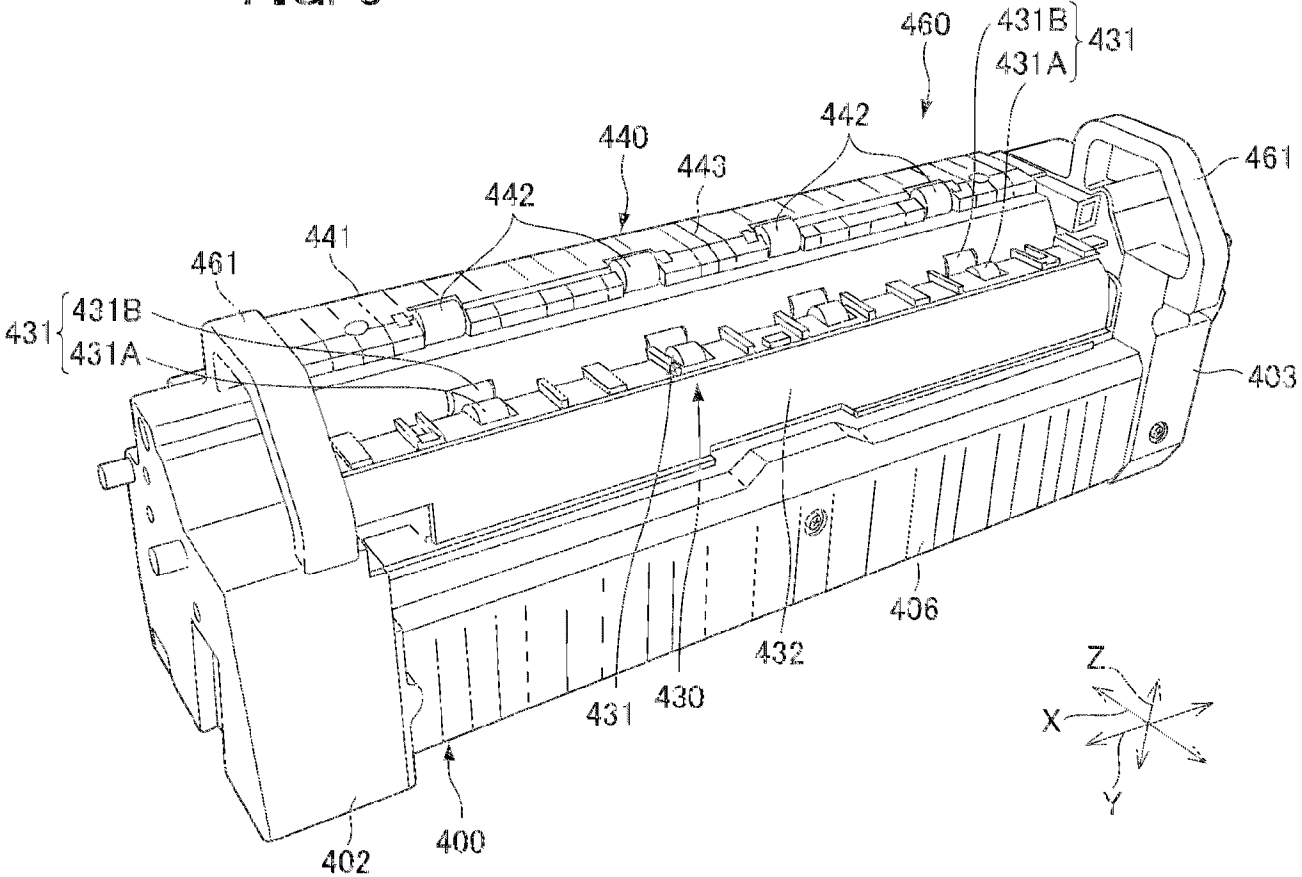
FIG. 5 is a perspective view of an external appearance of the fixing rotator unit 460 of the fixing apparatus 9, viewed externally from one side in the X direction.
Figure 6:
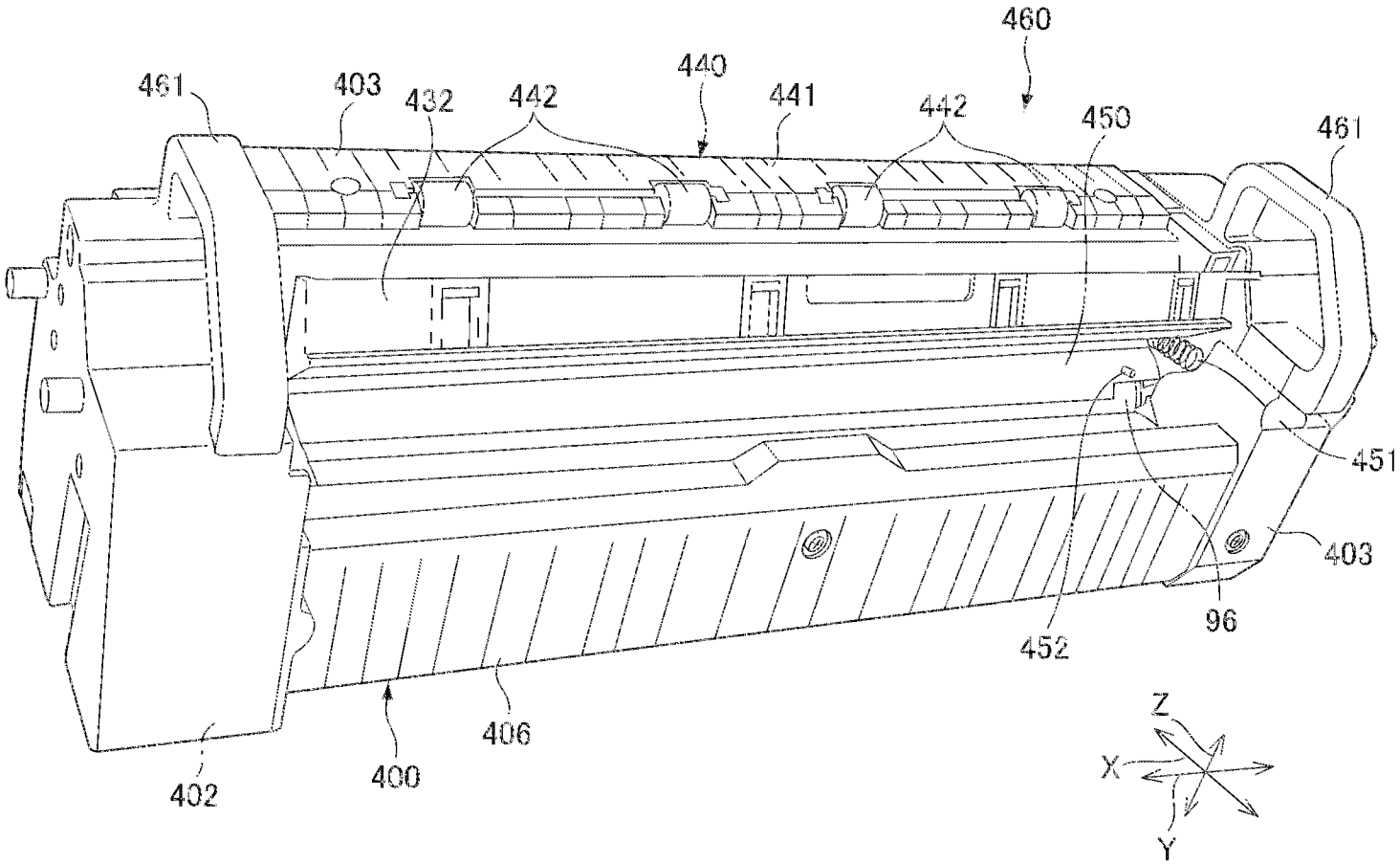
FIG. 6 is a perspective view showing a forced feed part 430 being rotated upward relative to the fixing rotator unit 460 shown in FIG. 5, viewed externally from t one side in the X direction.
Figure 7:
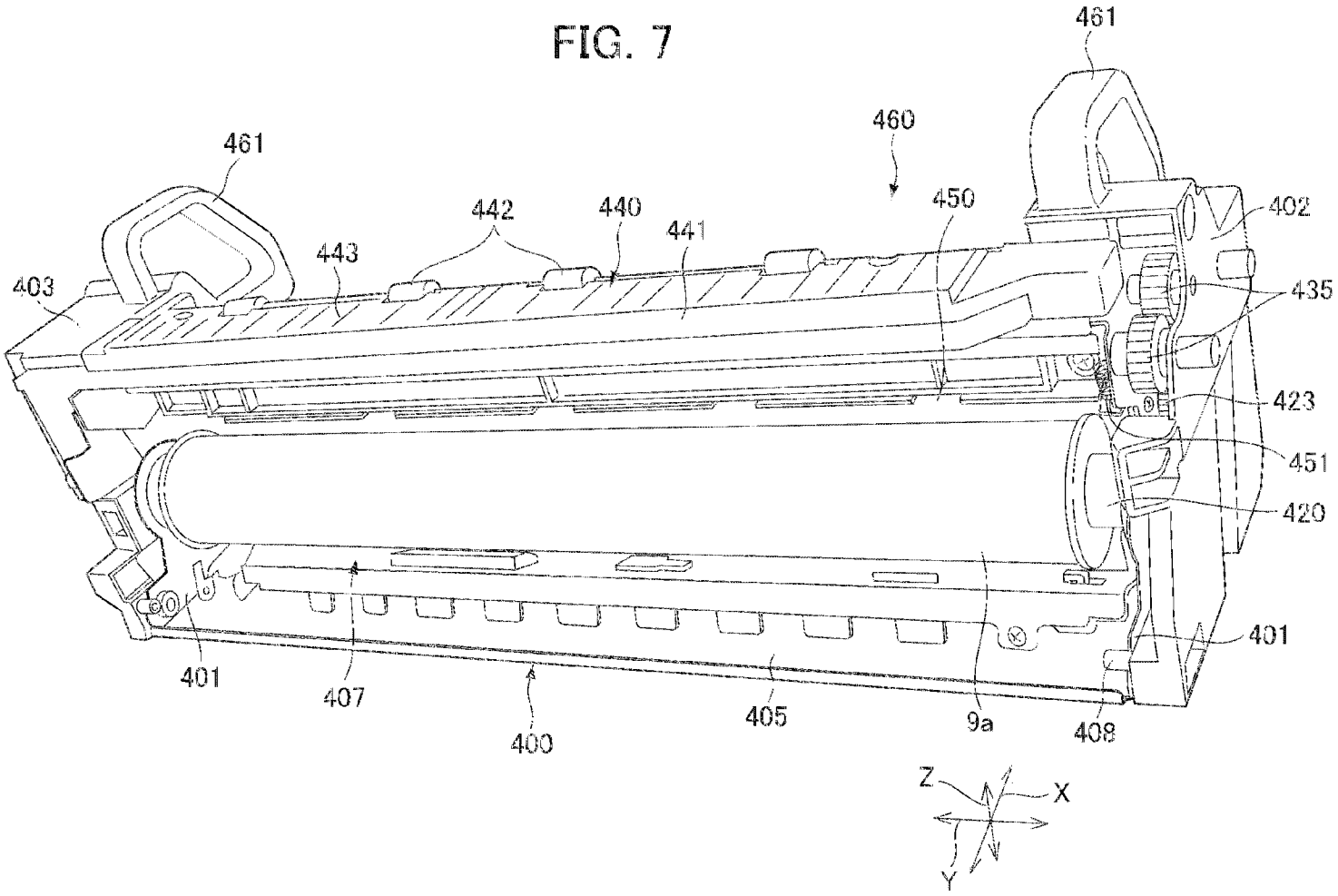
FIG. 7 is a perspective view showing an exposed heating rotator 9*a* associated with the fixing rotator unit 460 shown in FIG. 5, viewed externally from the other side in the X direction.
Figure 8:
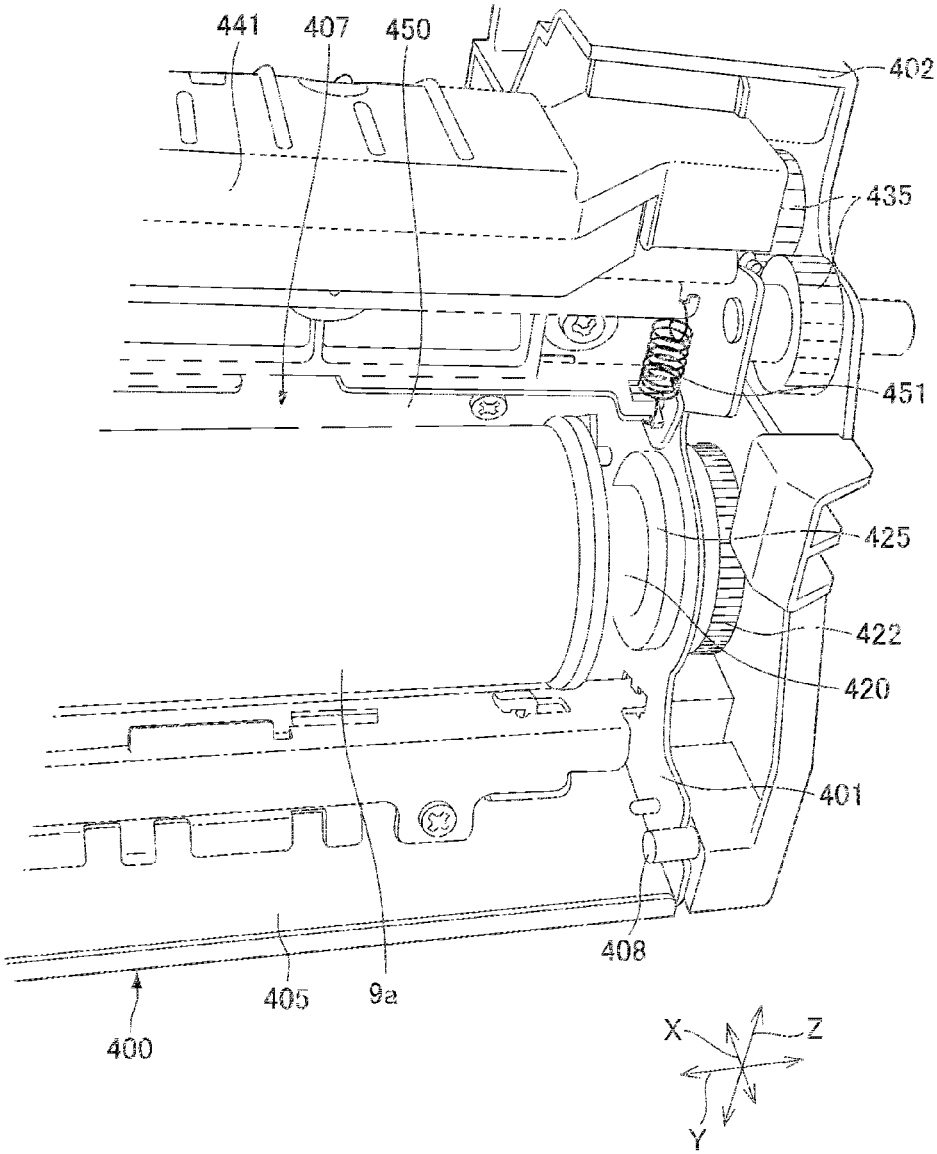
FIG. 8 is an enlarged perspective view of main parts of the fixing rotator unit 460 shown in FIG. 7.
Figure 9:
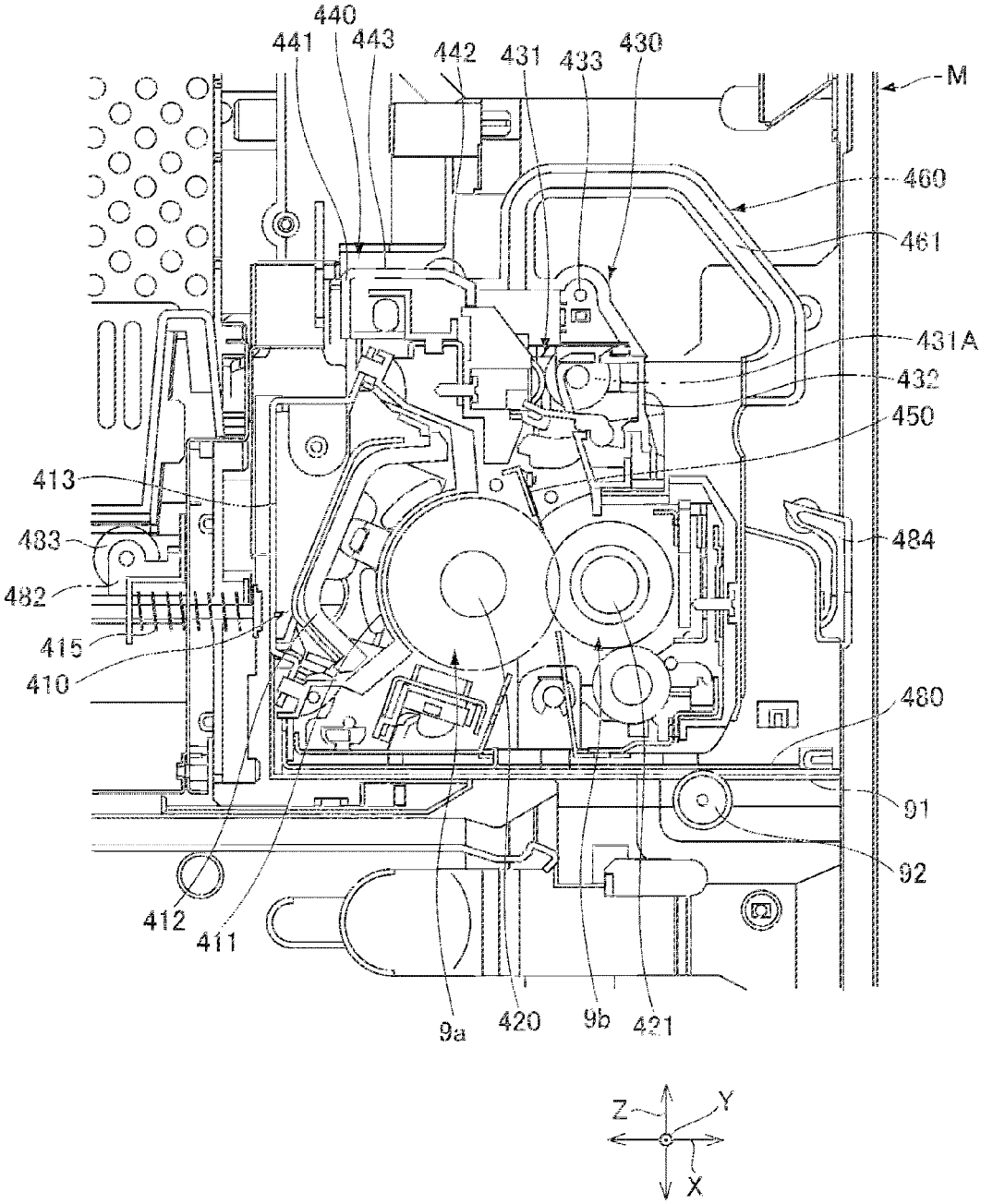
FIG. 9 is an enlarged vertical cross-sectional view showing the fixing rotator unit 460 being housed in a space 90 of the apparatus main body M shown in FIG. 11.

FIG. 5 is a perspective view of an external appearance of the fixing rotator unit 460 of the fixing apparatus 9, viewed externally from one side in the X direction. FIG. 6 is a perspective view showing the forced feed part 430 being rotated upward relative to the fixing rotator unit 460 shown in FIG. 5, viewed externally from one side in the X direction. FIG. 7 is a perspective view showing the exposed heating rotator 9*a* associated with the fixing rotator unit 460 shown in FIG. 5, viewed externally from the other side in the X direction. FIG. 8 is an enlarged perspective view of the fixing rotator unit 460 shown in FIG. 7. FIG. 9 is an enlarged vertical cross-sectional view showing the fixing rotator unit 460 being housed in a space 90 of the apparatus main body M shown in FIG. 11.

The fixing apparatus 9 of the present embodiment feeds a sheet of paper T, to which an unfixed toner image is transferred, in a feed direction while the sheet of paper T is pressed against the heated peripheral surface of the heating rotator 9*a* by the pressurizing rotator 9*b*. Accordingly, the fixing apparatus 9 heats and pressurize to cause the toner image to be fused, and fixes the toner image on a surface of the sheet of paper T.

The fixing rotator unit 460 including the fixing apparatus 9 is configured to be withdrawable in the direction X (an outward right direction in FIG. 1) from the apparatus main body M as shown in FIGS. 3 and 4, when the cover unit 40 is open as shown in FIG. 2.

The fixing rotator unit 460 is withdrawable in a direction (the direction X) orthogonal to an axis direction (the direction Y) of the a first rotational axis 420 of the heating rotator 9*a* and a second rotational axis 421 of the pressurizing rotator 9*b*.

Components of the fixing apparatus 9 will be described in detail hereafter.

As shown in FIGS. 5 to 9, the fixing apparatus 9 includes the heating rotator 9*a*, the pressurizing rotator 9*b*, a fixing housing 400, and an external heating mechanism 410 as a heat source provided outside the heating rotator 9*a*. In the fixing apparatus 9, the fixing rotator unit 460, which is detachable from the apparatus main body M and unitized, is composed of the heating rotator 9*a*, the pressurizing rotator 9*b*, the fixing housing 400, a forced feed part 430 (to be described later), a feed guide 440 (to be described later), a separating plate 450 (to be described later) and the like.

The heating rotator 9*a* is configured to be rotatable about the center of the first rotational axis 420 extending in the direction Y. The heating rotator 9*a* is configured, for example, in a three-layered structure in which a peripheral surface of a cylindrical metallic member of aluminum, iron or the like of approximately 40 mm in diameter is covered by an elastic layer of silicon rubber or the like of approximately 150 to 300 μm in thickness and an endless nickel belt. The peripheral surface of the heating rotator 9*a* is heated by the external heating mechanism 410 provided outside the heating rotator 9*a* (to be described later in detail).

The pressurizing rotator 9*b* is configured to be rotatable about the center of the second rotational axis 421 that is parallel to the first rotational axis 420 and extends in the direction Y. The pressurizing rotator 9*b* is formed in a cylindrical shape of a predetermined outside diameter, in which an elastic layer of a predetermined thickness of silicon rubber or the like is formed on a periphery of a cylindrical metallic member.

The pressurizing rotator 9*b* and the heating rotator 9*a* form between them a fixing nip N9 into which a sheet of paper T is fed (see FIG. 1). The pressurizing rotator 9*b* is disposed to push the heating rotator 9*a* in a state in which the fixing nip N9 is formed. Consequently, a part of the heating rotator 9*a* facing the pressurizing rotator 9*b* elastically deforms along the surface shape of the pressurizing rotator 9*b*.

As shown in FIG. 9, the heating rotator 9*a* and the pressurizing rotator 9*b* are housed in the fixing housing 400. As shown in FIGS. 5 to 8, both end parts of each of the first rotational axis 420 of the heating rotator 9*a* and the second rotational axis 421 of the pressurizing rotator 9*b* are rotatably supported by side plate parts 401, 401 of the fixing housing 400. First end portions of the first rotational axis 420 of the heating rotator 9*a* and the second rotational axis 421 of the pressurizing rotator 9*b* penetrate a side plate part 401 on a first end side of the fixing housing 400, extending inside a frame member 402 of a pair of frame members 402 and 403 fixed to both end portions of the fixing housing 400. As shown in FIG. 8, a bearing 425 that supports the first rotational axis 420 smoothly rotatable is provided to each of the pair of frame members 402 and 403 (only the bearing 425 for the frame member 402 is illustrated). The bearing 425 is placed more inward than the frame members 402 and 403 in an axis direction of the heating rotator 9*a* and the pressurizing rotator 9*b* (direction Y).

As shown in FIGS. 7 and 8, gears 422 and 423 engaging with each other are fixed to the first end portion of the first rotational axis 420 of the heating rotator 9*a* and the first end portion of the second rotational axis 421 of the pressurizing rotator 9*b*, respectively, inside the frame member 402. The gears 422 and 423 operate with a rotational actuator such as a motor (not illustrated), while engaging with a driving gear attached to the rotational actuator. In this manner, the heating rotator 9*a* and the pressurizing rotator 9*b* are rotationally driven opposite to each other, following driving provided by the rotational actuator, such that the sheet of paper T is fed in a predetermined direction.

As shown in FIGS. 6 to 8, the fixing housing 400 includes a bottom plate part 405, side plate parts 401, 401, a wall part 406, an opening 407, and a rotation stopper 408. The wall part 406 stands upright in the direction Z from the bottom plate part 405, on a side of a right lateral face of the apparatus main body M. The opening 407 is open toward inside the apparatus main body M, such that the heating rotator 9*a* is exposed.

As shown in FIG. 8, a rotation stopper 408 is provided for each of the frame members 402 and 403 (only the rotation stopper 408 of the frame body 402 is illustrated). The rotation stopper 408 projects inward in an axial direction of the heating rotator 9*a* and the pressurizing rotator 9*b* (the direction Y). The rotation stopper 408 prevents (stop) the external heating mechanism 410 from rotating toward the fixing rotator unit 460. This function of the rotation stopper 408 will be described later in a description of operation of the fixing apparatus 9.

The fixing housing 400 includes the forced feed part 430, a lid member 432 and the feed guide 440 above the heating rotator 9*a* and the pressurizing rotator 9*b*. The forced feed part 430 and the feed guide 440 form a part of the third paper feed path L3, which feeds a sheet of paper T having passed through the fixing nip N9.

The forced feed part 430 is provided with a pair of forced feed rollers 431 (431A, 431B). The pair of forced feed rollers 431 sandwiches the sheet of paper T that has passed through the fixing nip N9 and rotates with respect to each other to forcibly feed the sheet of paper T toward the feed guide 440 on a downstream side. The pair of forced feed rollers 431, as a whole, has a length in the direction Y that is greater than or equal to a width of the passing sheet of paper T. The pair of forced feed rollers 431 includes mutually engaging gears 435, respectively, and is driven by the abovementioned rotational actuator such as a motor.

Figure 14:
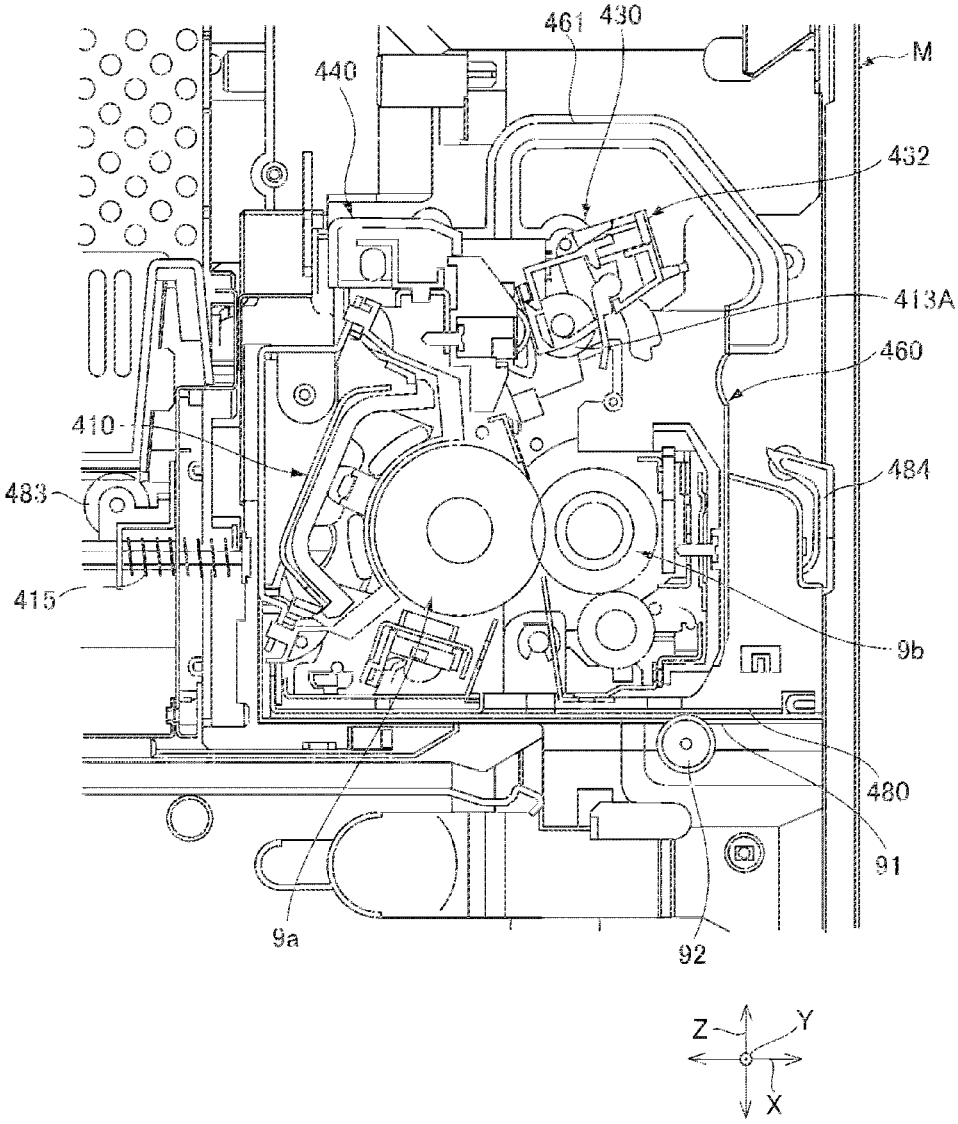
FIG. 14 is an enlarged vertical cross-sectional view of main parts describing an example of jam troubleshooting performed while the fixing rotator unit 460 is housed in the space 90 of the apparatus main body M.

The lid member 432 is disposed above the pressurizing rotator 9*b* and supported swingably about an upper portion of the lid member 432 by the fixing housing 400. As shown in FIG. 9, in a normal state, the lid member 432 is biased in a direction approaching the pressurizing rotator 9*b* and locked at a predetermined position. The lid member 432 covers a space above the fixing nip N9 under this condition. As shown in FIG. 14, rotation of the lid member 432 in a direction away from the pressurizing rotator 9*b* allows a hand of an user to enter the space above the fixing nip N9, when a paper jam occurs in the space above the fixing nip N9 and the like.

Figure 11:
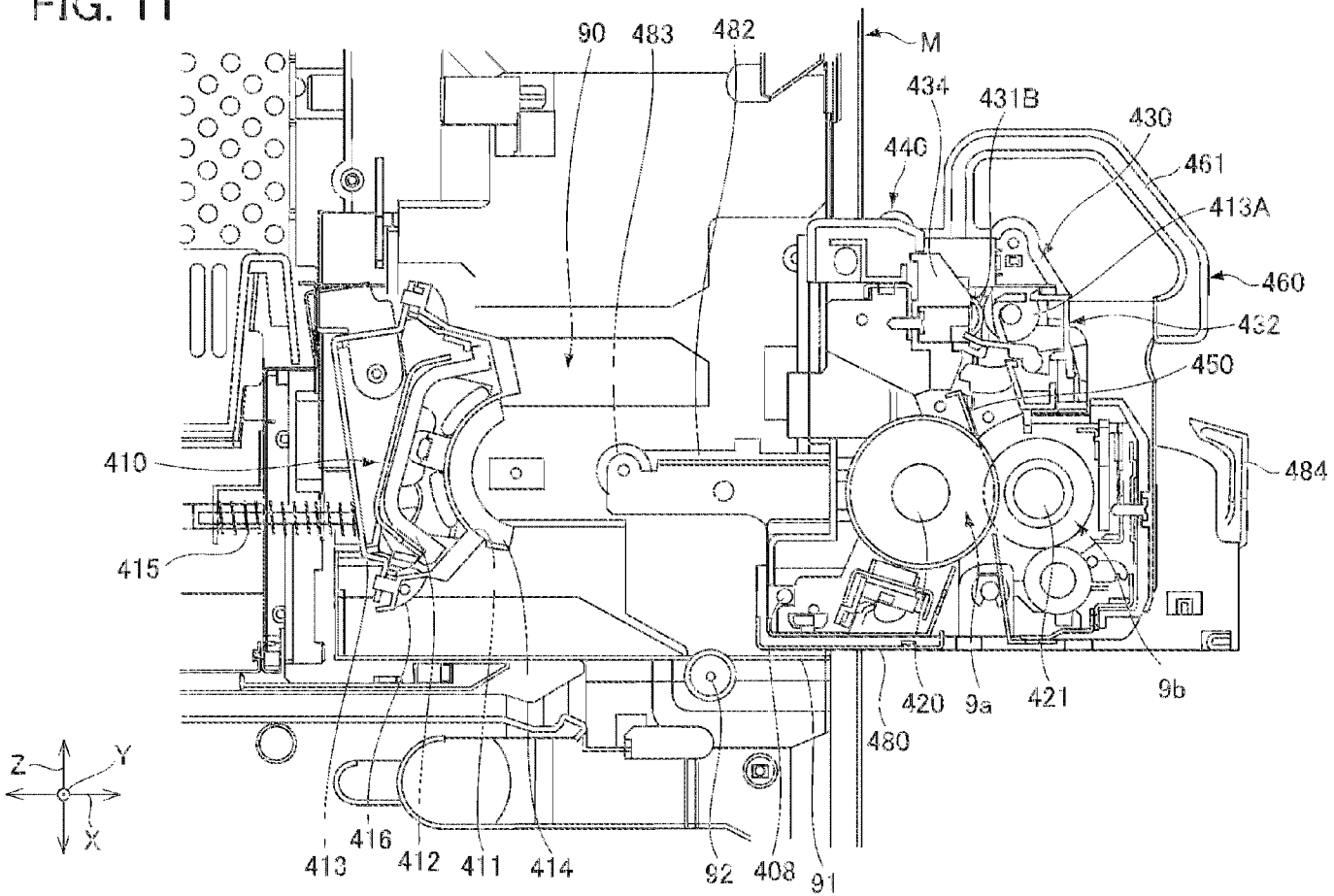
FIG. 11 is an enlarged vertical cross-sectional view of main parts showing the fixing rotator unit 460 having been withdrawn from the space 90 of the apparatus main body M.

As shown in FIG. 11, a roller supporting member 434 rotatably supports a second roller 431B of the pair of forced feed rollers 431.

The feed guide 440 is disposed more downstream than the forced feed part 430 with respect to a feed direction of a sheet of paper T. The feed guide 440 includes an elongated plate member 441 and a plurality of free rotation rollers 442. The plate member 441 is secured to the frame members 402 and 403 to bridge them, which are two end portions of the fixing housing 400. The free rotation rollers 442 are rotatably supported by the plate member 441 at constant intervals in a longitudinal direction of the plate member 441 (the direction Y). A peripheral surface of each of the plurality of free rotation rollers 442 is partially exposed to the outside of the plate member 441.

The feed guide 440 is configured to be rotatable in a direction approaching the peripheral surface of the heating rotator 9*a*. The feed guide 440 is disposed above the heating rotator 9*a*, biased in a direction away from the heating rotator 9*a* in a normal state, and covers the space above the hearing rotator 9*a*. In addition, rotation of the feed guide 440 in a direction approaching the heating rotator 9*a* provides the space that allows a hand of the user to enter between the heating rotator 9*a* and the external heating mechanism 410, when a paper jam or the like occurs.

The fixing rotator unit 460 is provided with the plate-like separating plate 450 as a separating member adjacent to a position downstream of the fixing nip N9. The separating plate 450 removes the sheet of paper T that has passed through the fixing nip N9 from the peripheral surface of the heating rotator 9*a*. An end portion of the separating plate 450 is configured by means of an elastic biasing force of a spring 451, such that a tip of the separating plate 450 lies adjacent to or comes in slight contact with the peripheral surface of the heating rotator 9*a*. The separating plate 450 extends in a width direction of the sheet of paper T (depth direction Y) and has a length substantially the same or greater than the width of the sheet of paper T (length in the direction Y). As shown in FIG. 6, separating pins 452 are provided adjacent to both end portions respectively, in a longitudinal direction (direction Y) of the separating plate 450 (only one of the separating pins 452 is illustrated). The separating pins 452 separate the sheet of paper T from the separating plate 450, which has been removed from the peripheral surface of the heating rotator 9*a* by the separating plate 450.

Handles 461, which are used for withdrawing, separating and loading the fixing rotator unit 460, are provided in the frame members 402, 403 of the fixing housing 400.

A configuration regarding withdrawal of the fixing rotator unit 460 will be described in detail hereinafter.

As shown in FIGS. 3, 4 and 9 to 13, the apparatus main body M includes the rail part 480 that withdrawably supports the fixing rotator unit 460, and a fixing guide rail part 91 and a guiding roller 92 that guide the rail part 480.

The fixing guide rail part 91 is disposed at a bottom of the space 90 of the apparatus main body M in which the fixing apparatus 9 is housed. The rail part 480 is placed on the fixing guide rail part 91. The rail part 480 is configured to be withdrawable and pushable with respect to the space 90, along the fixing guide rail part 91. The guiding roller 92 is rotatably supported by the fixing guide rail part 91. The guiding roller 92, which comes into contact with a lower surface of the rail part 480, smoothly guides the rail part 480 in a withdrawing direction and a loading direction.

Figure 13:
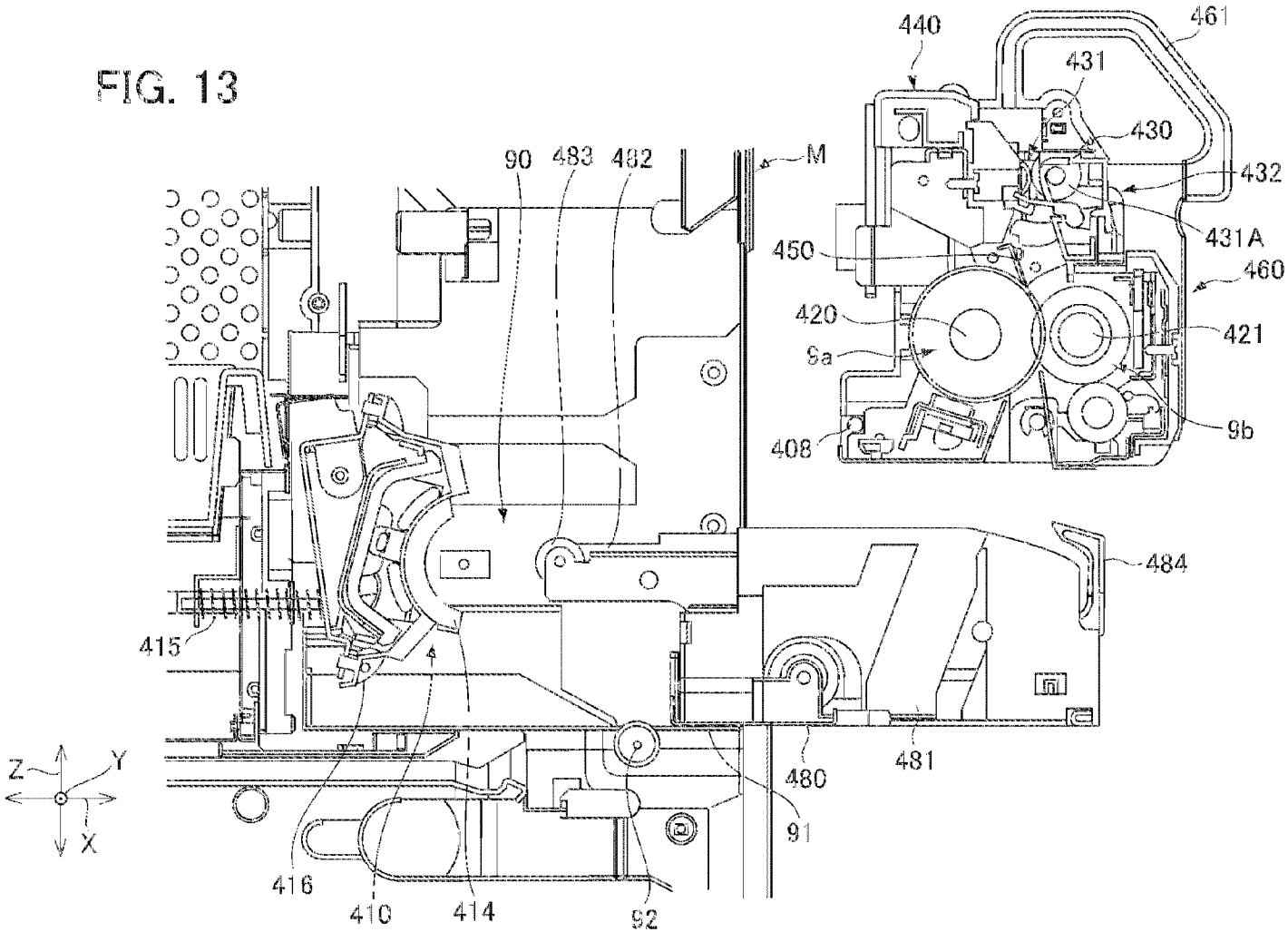
FIG. 13 is an enlarged vertical cross-sectional view of main parts showing a the fixing rotator unit 460 that is withdrawn from the space 90 of the apparatus main body M and removed from the rail part 480.

The rail part 480 is provided with a concave-shaped unit mount 481 as shown in FIG. 13, an operating lever 484, a movable frame part 482, and a roller 483.

The unit mount 481 is formed on an upper face of the rail part 480. The unit mount 481 is where a lower end part of the fixing housing 400 is accommodated in the fixing rotator unit 460. The fixing rotator unit 460 is configured to be detachable from the rail part 480 if it is extracted upward from the unit mount 481 at a position where it is withdrawn from the apparatus main body M as shown in FIGS. 4 and 13. In addition, the fixing rotator unit 460 is configured to be housed and fixed in the rail part 480 if it is lowered into the unit mount 481 at a position where it is withdrawn from the apparatus main body M as shown in FIGS. 4 and 13.

The operating lever 484 is configured to unlock the lock mechanism (not illustrated) provided between the rail part 480 and the apparatus main body M.

The movable frame part 482 moves in withdrawing and loading directions integrally with the rail part 480. The movable frame part 482 is connected to the rail part 480 such that the movable frame part 482 projects in a loading direction of the rail part 480.

The roller 483 is rotatably supported at an end portion of the movable frame part 482. As shown in FIG. 9, when the fixing rotator unit 460 is housed in the space 90 of the apparatus main body M, the roller 483 comes into contact with a lower face of the fixing guide rail part 91 inside the apparatus main body M, such that the roller 483 causes a posture of the fixing rotator unit 460 housed in the space 90 to be stably maintained.

As shown in FIG. 9, the external heating mechanism 410 is disposed at a position outside the heating rotator 9*a* and opposite to the pressurizing rotator 9*b* in the space 90 of the apparatus main body M. As shown in FIGS. 9 to 12, the external heating mechanism 410 is provided with an exciting coil 411, a core 412, an arcuate rib 414, a rotation stopper receiver 416, and a frame part 413 that supports the exciting coil 411, the core 412, the arcuate rib 414, and the rotation stopper receiver 416.

The exciting coil 411 is composed of a litz wire (not shown) of bundles of tens to hundreds of thin wires covered with heat-resistant resin, which is coiled along an axis direction of the heating rotator 9*a*. The exciting coil 411 is connected to a high-frequency inverter (not illustrated) by which it is supplied high-frequency electricity. As magnetic flux generated by the exciting coil 411 is guided to the heating rotator 9*a* via the core 412, the heating rotator 9*a* is heated by electromagnetic induction.

The external heating mechanism 410 is rotatable about a fulcrum shaft provided in an upper end portion of the frame part 413. The fulcrum shaft has a slight play. The external heating mechanism 410 is configured such that the exciting coil 411 is disposed adjacent to or in contact with the peripheral surface of the heating rotator 9*a* and heats the peripheral surface of the heating rotator 9*a* by electromagnetic induction.

The arcuate rib 414 has a curved contacting face that contacts the bearing 425 in the fixing rotator unit 460 when the exciting coil 411 is disposed adjacent to or in contact with the peripheral surface of the heating rotator 9*a*, and receives a force from the fixing rotator unit 460.

The rotation stopper receiver 416 contacts the rotation stopper 408 when the exciting coil 411 is disposed adjacent to or in contact with the peripheral surface of the heating rotator 9*a*, and receives a force from the fixing rotator unit 460.

The external heating mechanism 410 causes the exciting coil 411, the core 412, the frame part 413, the arcuate rib 414 and the rotation stopper receiver 416 to rotate about the fulcrum shaft. A coil spring 415 presses to bias an inner peripheral surface of the core 412 against an outer peripheral surface of the heating rotator 9*a*, and is disposed between the apparatus main body M and the frame part 413. The coil spring 415 is configured to apply a biasing force in the withdrawal direction of the fixing rotator unit 460.

Next, operation of the copy machine 1 according to the present embodiment will be briefly described with reference to FIG. 1.

First, single-side printing on a sheet of paper T housed in the paper feeding cassette 52 is described.

The sheet of paper T contained in the paper feeding cassette 52 is fed to the first paper feed path L1 by the forward feed roller 61 and the pair of paper feeding rollers 81. Subsequently, the sheet of paper T is fed to the pair of resist rollers 80 by the pair of intermediate rollers 82 via the first junction P1 and the first paper feed path L1.

The pair of resist rollers 80 performs skew compensation of the sheet of paper T and timing adjustment with respect to a toner image.

The sheet of paper T discharged from the pair of resist rollers 80 is introduced between the intermediate image transfer belt 7 and the secondary image transfer roller 8 (the secondary image transfer nip N2) via the first paper feed path L1. A toner image is transferred to the sheet of paper T between the intermediate image transfer belt 7 and the secondary image transfer roller 8.

Thereafter, the sheet of paper T is discharged from between the intermediate image transfer belt 7 and the secondary image transfer roller 8, and introduced into the fixing nip N9 between the heating rotator 9*a* and the pressurizing rotator 9*b* in the fixing apparatus 9. Toner is then fused in the fixing nip N9 and fixed onto the sheet of paper T.

Subsequently, the sheet of paper T is fed to the discharging part 50 via the third paper feed path L3 and discharged from the discharging part 50 to the discharged paper collection part M1 by the pair of discharging rollers 53.

Single-side printing on the sheet of paper T contained in the paper feeding cassette is thus completed.

In a case of single-side printing on a sheet of paper T placed on the manual feeding tray 65, the sheet of paper T is fed to the manual paper feed path La by the paper feeding roller 66, and then fed to the pair of resist rollers 80 via the first junction P1 and the first paper feed path L1. Subsequent operations are the same as single-side printing on a sheet of paper T contained in the paper feeding cassette 52, and descriptions thereof are omitted.

Next, operation of the copy machine 1 performing duplex printing will be described.

In a case of single-side printing, as described above, printing is completed by discharging the sheet of paper T printed on one side from the paper discharging part 50 to the discharged paper collection part M1.

On the other hand, in a case of duplex printing, a sheet of paper T, one side of which has been printed, is reversed and re-fed to the pair of resist rollers 80 via the reverse paper feed path Lb.

In more detail, the operation is the same as the abovementioned single-side printing until a step prior to discharging of the sheet of paper T, one side of which has been printed, from the paper discharging part 50 performed by the pair of discharging rollers 53. However, in a case of duplex printing, the pair of discharging rollers 53 stops rotating and resumes rotating in an opposite direction, while the sheet of paper T, one side of which has been printed, is held by the pair of discharging rollers 53. When the pair of discharging rollers 53 rotates in the opposite direction, the sheet of paper T held by the pair of discharging rollers 53 is fed in an opposite direction in the third paper feed path L3 (a direction from the paper discharging part 50 to the first junction Q1).

As described above, when the sheet of paper T is fed in the opposite direction in the third paper feed path L3, the sheet of paper T is guided to the reverse paper feed path Lb by the regulating member 58 and enters the first paper feed path L1 via the second junction P2. Here, the sheet of paper T is turned upside down from the position of one-side printing.

Furthermore, the pair of resist rollers 80 performs the abovementioned compensation or the abovementioned adjustment on the sheet of paper T, which is then introduced between the photoreceptor drum 2 and the secondary image transfer roller 8 via the first paper feed path L1. Since an unprinted surface of the sheet of paper T faces the image transfer roller 8 as a result of passing through the reverse paper feed path Lb, a toner image is transferred to the unprinted surface and duplex printing is performed.

Next, operation of the fixing apparatus 9, which is a distinguishing feature of the copy machine 1 according to the present invention, will be described with reference to FIGS. 9 to 14.

Figure 10:
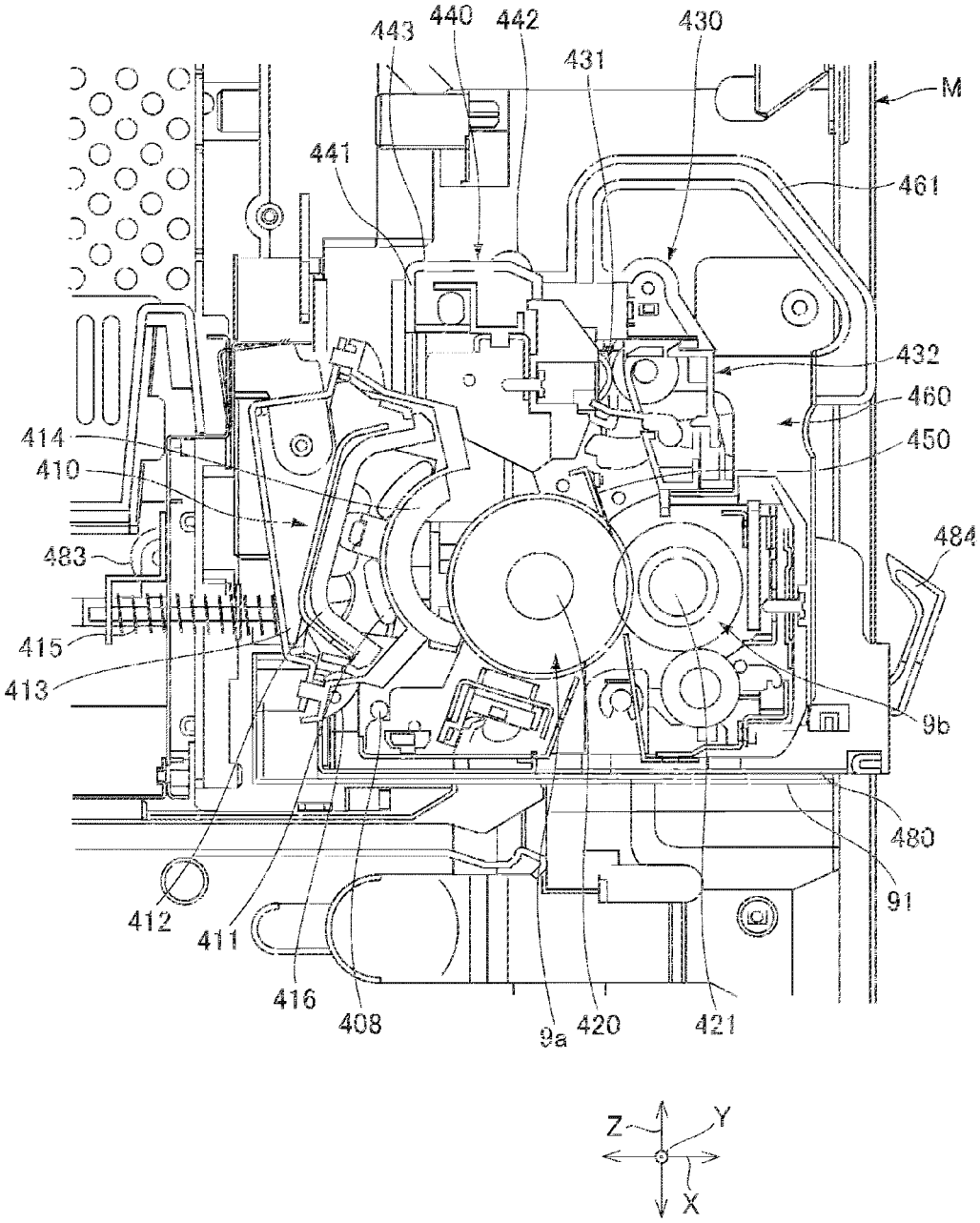
FIG. 10 is an enlarged vertical cross-sectional view of main parts showing the fixing rotator unit 460 immediately after its start of being withdrawn from the space 90 of the apparatus main body M shown in FIG. 11.
Figure 12:
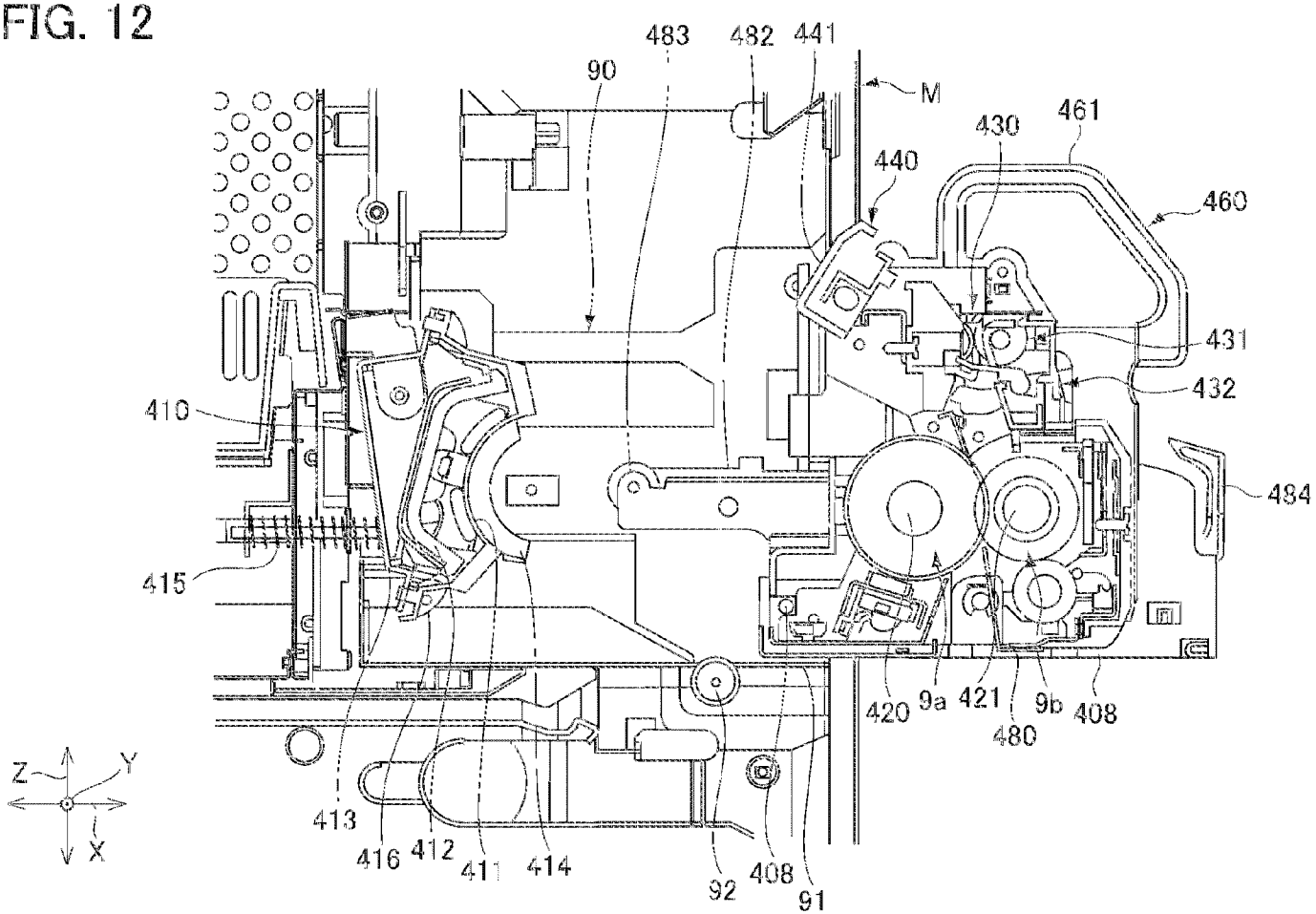
FIG. 12 is an enlarged vertical cross-sectional view of main parts showing a feed guide 440 being rotated toward the peripheral surface of the heating rotator 9*a* compared with FIG. 11.

FIG. 10 is an enlarged vertical cross-sectional view of main parts showing the fixing rotator unit 460 immediately after its start of being withdrawn from the space 90 of the apparatus main body M shown in FIG. 11. FIG. 11 is an enlarged vertical cross-sectional view of the main parts, showing the fixing rotator unit 460 having been withdrawn from the space 90 of the apparatus main body M. FIG. 12 is an enlarged vertical cross-sectional view of a main part showing a feed guide 440 being rotated toward the peripheral surface of the heating rotator 9*a* compared with FIG. 11. FIG. 13 is an enlarged vertical cross-sectional view of the main parts showing the fixing rotator unit 460 that is withdrawn from the space 90 of the apparatus main body M and removed from the rail part 480. FIG. 14 is an enlarged vertical cross-sectional view of the main parts describing an example of jam troubleshooting performed while the fixing rotator unit 460 is housed in the space 90 of the apparatus main body M.

First, detachment of the fixing rotator unit 460 from the apparatus main body M will be described.

As shown in FIG. 9, in a normal printing (when the fixing rotator unit 460 is housed in the space 90 of the apparatus main body M), magnetic flux generated by the exciting coil 411 of the external heating mechanism 410 is guided to the heating rotator 9*a* via the core 412, and the heating rotator 9*a* is heated by electromagnetic induction. When a sheet of paper T, onto which a toner image has been transferred, passes through the fixing nip N9 between the heating rotator 9*a* and the pressurizing rotator 9*b*, the fixing apparatus 9 fuses the toner image by heating and pressurizing, and fixes the toner image on a surface of the sheet of paper T.

The pair of forced feed rollers 431 of the forced feed part 430 sandwiches the sheet of paper T onto which the toner image has been fixed, and rotates with respect to each other. In this manner, the sheet of paper T is forcedly fed toward the feed guide 440 on a downstream side. Subsequently, the sheet of paper T slides on surfaces of the plurality of free rotation rollers 442 and the plate member 441 of the feed guide 440. The sheet of paper T is fed in the third paper feed path L3 toward the discharging part 50 while guided in a predetermined direction along a feed guiding surface 443, and discharged from the discharging part 50 to the discharged paper collection part M1 by the pair of discharging rollers 53.

In case a paper jam or the like occurs inside the fixing apparatus 9 due to a sheet of paper T not being discharged from the fixing apparatus 9 in normal printing as described above, a user opens the cover unit 40 as a first step as shown in FIG. 2. When the cover unit 40 is open, the user operates the operating lever 484 to unlock the lock mechanism (not illustrated) provided between the rail part 480 and the apparatus main body M, as shown in FIG. 10.

After the lock mechanism is unlocked, the user grips the handle 461 to withdraw and move the rail part 480 from the space 90 along the fixing guide rail part 91, as shown in FIGS. 2 and 10. As a result, the fixing rotator unit 460 mounted on the unit mount 481 of the rail part 480 is withdrawn outside the apparatus main body M (in the direction X) integrally with the rail part 480.

When the rail part 480 and the fixing rotator unit 460 are withdrawn, the external heating mechanism 410 rotates about the fulcrum shaft in a withdrawal direction of the rail part 480 under receiving the biasing force applied by the coil spring 415. Such a rotational force of the external heating mechanism 410 is applied in the withdrawal direction of the rail part 480 and the fixing rotator unit 460 via the arcuate rib 414 and the bearing 425. Accordingly, the user can withdraw the rail part 480 and the fixing rotator unit 460 by applying a small amount of force to the fixing rotator unit 460 in the withdrawal direction.

Thereafter, the user grips the handle 461 to withdraw the rail part 480 and the fixing rotator unit 460 to a predetermined position, as shown in FIGS. 3 and 11.

When the fixing rotator unit 460 has been withdrawn to the predetermined position, a space allowing a hand of the user to enter between the heating rotator 9*a* and the external heating mechanism 410 is formed if the feed guide 440 is rotated in a direction approaching the peripheral surface of the heating rotator 9*a*, as shown in FIG. 12. In a case of a minor paper jam due to feeding of a sheet of paper T being interrupted between the heating rotator 9*a* and the pressurizing rotator 9*b* and the like, it is possible for the user to troubleshoot the jam by simply inserting his hand to remove the sheet of paper T through the gap.

On the other hand, a more serious paper jam may occur in the fixing process. For example, a paper jam may occur, in which a sheet of paper T enters a small gap between the tip of the separating plate 450 and the surface of the heating rotator 9*a* and rolls up tightly around the peripheral surface of the heating rotator 9*a*, accompanying rotation of the heating rotator 9*a*. In such a case, even if the user inserts his hand through the abovementioned gap between the heating rotator 9*a* and the external heating mechanism 410, it is extremely difficult to troubleshoot jamming.

In a case of such a serious paper jam, the user grips the handle 461 to pull up the fixing rotator unit 460 from the unit mount 481 of the rail part 480 and detach the fixing rotator unit 460 from the rail part 480 as shown in FIGS. 4 and 13, while the rail part 480 is withdrawn to a predetermined position.

When the fixing rotator unit 460 is detached from the rail part 480, approximately half of the peripheral surface of the heating rotator 9*a* of the fixing rotator unit 460 is exposed outward through the opening 407 of the fixing housing 400 as shown in FIG. 7. Accordingly, it is possible for the user to easily troubleshoot the paper jam by removing the sheet of paper T tightly rolled up around the peripheral surface of the heating rotator 9*a* on a side of the opening 407 of the fixing housing 400.

Next, attachment of the fixing rotator unit 460 to the apparatus main body M will be briefly described. The attachment is basically the same (in a reversed order) as the abovementioned detachment. A description is given mainly concerning operations relating to the bearing 425, the arcuate rib 414, the rotation stopper 408 and the rotation stopper receiver 416.

After the completion of jam troubleshooting, the user lowers the fixing rotator unit 460 from above the unit mount 481 of the rail part 480 (see FIG. 13) such that the fixing rotator unit 460 is housed and fixed to the rail part 480 as shown in FIG. 11. Subsequently, as shown in FIGS. 9 and 10, the user pushes and moves the rail part 480 toward the space 90 of the apparatus main body M along the fixing guide rail part 91, thereby housing the rail part 480 in the space 90.

Under such steps, the bearing 425, the arcuate rib 414, the rotation stopper 408 and the rotation stopper receiver 416 perform the following operations.

As shown in FIG. 10, when the fixing rotator unit 460 approaches the external heating mechanism 410, the bearing 425 (see FIG. 8) of the fixing rotator unit 460 pushes the arcuate rib 414 of the external heating mechanism 410 obliquely upward. Accordingly, the external heating mechanism 410 is raised obliquely upward. Since the fulcrum shaft of the external heating mechanism 410 has only a slight amount of play, the external heating mechanism 410 starts rotating toward the fixing rotator unit 460 after it is raised to a certain degree.

When the rotation stopper receiver 416 of the external heating mechanism 410 comes into contact with the rotation stopper 408 of the fixing rotator unit 460, rotation of the external heating mechanism 410 is restricted. In this manner, the external heating mechanism 410 and the fixing rotator unit 460 are positioned.

When the rail part 480 and the fixing rotator unit 460 are housed in the space 90 of the apparatus main body M, the exciting coil 411 of the external heating mechanism 410 approaches or contacts the peripheral surface of the heating rotator 9*a* to be ready again for electromagnetic induction heating. Thereafter, the copy machine 1 is restored to a normal printable state if the cover unit 40 is closed.

It should be noted that in a case of a minor paper jam where feeding of a sheet of paper T is interrupted due to the sheet of paper T being jammed between the heating rotator 9*a* and the pressurizing rotator 9*b*, the user can easily remove the sheet of paper T by swinging the lid member 432 upward as shown in FIG. 14 such that the user is allowed to put his hand above the pressurizing rotator 9*b*, while the cover unit 40 is in an open position.

The fixing apparatus 9 of the present embodiment provides, for example, the following effects.

The fixing apparatus 9 of the present embodiment includes: the heating rotator 9*a* of which the peripheral surface is heated by the external heating mechanism 410 provided outside the heating rotator 9*a*; the pressurizing rotator 9*b* that forms the fixing nip N9 between the heating rotator 9*a* and the pressurizing rotator 9*b*; and the fixing housing 400 that houses the heating rotator 9*a* and the pressurizing rotator 9*b*, in which the heating rotator 9*a*, the pressurizing rotator 9*b* and the fixing housing 400 compose the fixing rotator unit 460 and the fixing rotator unit 460 is configured to be withdrawable from the apparatus main body M of the copy machine 1 and such that the peripheral surface of the heating rotator 9*a* is exposed when the fixing rotator unit 460 is withdrawn from the apparatus main body M.

Accordingly, when a paper jam occurs in the fixing apparatus 9 of the present embodiment, a user can expose the peripheral surface of the heating rotator 9*a* by withdrawing the fixing rotator unit 460 from the apparatus main body M. As a result, even when a sheet of paper T tightly rolls up around the peripheral surface of the heating rotator 9*a* in the fixing processing, the user can easily and handily troubleshoot the jam with a large work space in order to remove the sheet of paper T rolled up around the peripheral surface of the heating rotator 9*a*.

In the fixing apparatus 9 of the present embodiment, the fixing rotator unit 460 is withdrawable in a direction orthogonal to the axis direction of the first rotational axis 420 and the second rotational axis 421 (the direction Y).

As a result, compared with a case where the fixing rotator unit 460 is withdrawn in the axis direction of the first rotational axis 420 and the second rotational axis 421 (the direction Y), it is possible to shorten a withdrawal stroke and reduce a space occupied by the fixing rotator unit 460 withdrawn on a side of the copy machine 1 occupied. As a result, it is possible to perform jam troubleshooting more easily and efficiently.

In addition, the fixing apparatus 9 of the present embodiment includes the external heating mechanism 410 as the heat source to heat the heating rotator 9*a*. The external heating mechanism 410 is disposed adjacent to or in contact with the peripheral surface of the heating rotator 9*a*, at a position outside the heating rotator 9*a* and opposite to the pressurizing rotator 9*b*.

As a result, the heat source does not interfere with the withdrawal of the fixing rotator unit 460 or does not require tiresome operation of disconnection from a power source when the fixing rotator unit 460 is withdrawn. In addition, the heat source does not require reconnection to the power source when the fixing rotator unit 460 is loaded. Accordingly, it is possible to perform jam troubleshooting that requires withdrawal of the fixing rotator unit 460 easily and quickly with fewer steps.

In addition, in the fixing apparatus 9 of the present embodiment, the external heating mechanism 410 includes the coil spring 415 that pushes and biases the external heating mechanism 410 toward the heating rotator 9*a*. The coil spring 415 is configured to apply a biasing force in the withdrawal direction of the fixing rotator unit 460.

As a result, it is possible to apply the biasing force of the coil spring 415 efficiently to the fixing rotator unit 460 as a withdrawing force when it is withdrawn. Accordingly, even if the fixing rotator unit 460 is large in size and heavy in weight, it is possible to withdraw it with a small force, thereby rendering jam troubleshooting to be easier.

In addition, in the fixing apparatus 9 of the present embodiment, the apparatus main body M includes the rail part 480 that supports the fixing rotator unit 460 withdrawably.

The fixing rotator unit 460 is configured to be detachable from the rail part 480 at a position where the fixing rotator unit is withdrawn from the apparatus main body M. Accordingly, when a serious paper jam occurs, which cannot be restored simply by withdrawing the rail part 480 to a predetermined position, it is possible to cause the heating rotator 9*a* to be totally exposed if the fixing rotator unit 460 is detached from the rail part 480. Therefore, the serious jam can also be easily and reliably restored.

In addition in the fixing apparatus 9 of the present embodiment, the fixing housing 400 includes the feed guide 440 that feeds the sheet of paper T having passed through the fixing nip N9, above the heating rotator 9*a*.

The feed guide 440 is configured to be rotatable in a direction approaching the heating rotator 9*a*. As a result, if the feed guide 440 is rotated in a direction approaching the peripheral surface of the heating rotator 9*a* while the fixing rotator unit 460 is withdrawn to the predetermined position, it is possible to provide a space allowing a hand to enter between the heating rotator 9*a* and the external heating mechanism 410. Accordingly, in a case of a minor paper jam, the user can remove a jammed sheet of paper T by putting his hand through the gap, without detaching the fixing rotator unit 460 from the rail part 480, thereby reducing the number of actions and the effort for jam troubleshooting.

In addition, in the fixing apparatus 9 of the present embodiment, the fixing rotator unit 460 is provided with the separating plate 450 adjacent to the fixing nip N9 on its downstream side. Accordingly, it may be that a serious paper jam occurs due to a sheet of paper T that enters a small gap between the end of the separating plate 450 and the surface of the heating rotator 9*a* and that tightly rolls up around the peripheral surface of the heating rotator 9*a*, following rotation of the heating rotator 9*a*.

Even in a case of such a serious jam, the fixing apparatus 9 of the present embodiment allows a user to perform jam troubleshooting efficiently as described above.

A preferred embodiment of the present invention has been described above; however, the present invention is not limited thereto and can be carried out in various modes.

For example, although the external heating mechanism 410 of an electromagnetic induction type is used as the heat source of the peripheral surface of the heating rotator 9*a* in the above embodiment, the present invention is not limited thereto. Alternatively, an electrothermal heater provided inside the heating rotator 9*a* may be used as the heat source.

Configuration of the heating rotator 9*a* and the pressurizing rotator 9*b* is not particularly limited, and the heating rotator 9*a* and the pressurizing rotator 9*b* may be composed of, for example, a rotator including a roller, a cylindrical (circular) rotator, and a rotating unit shaped like a belt stretched around a plurality of rollers.

In addition, the separating plate 450, having a length substantially the same as or greater than the width of the sheet of paper T (a length in the direction Y), is provided as a separating member for removing the sheet of paper T that has passed through the fixing nip N9, away from the peripheral surface of the heating rotator 9*a* in the above embodiment, but the present invention is not limited thereto. The separating plate 450 may alternatively be omitted or replaced by a plurality of separating claws separated in the width direction of a sheet of paper T (the direction Y).

The image forming apparatus of the present invention is not particularly limited, and may be a color copy machine, a printer, a facsimile machine, or a multi-functional printer having functions thereof.

In addition, the transfer object is not limited to paper, and may be a film sheet or a coated paper with a coating on a surface thereof, for example.

What is claimed is:

1. A fixing apparatus that fixes a toner image on a transfer object onto which the toner image is transferred, comprising:

a heating rotator configured to be rotatable about a first rotational axis, having a peripheral surface that is heated by a heat source provided inside or outside of the heating rotator;

a pressurizing rotator configured to be rotatable about a second rotational axis that is parallel to the first rotational axis, the pressurizing rotator forming a fixing nip in conjunction with the heating rotator; and a fixing housing configured to accommodate the heating rotator and the pressurizing rotator;

wherein the heating rotator, the pressurizing rotator and the fixing housing form a fixing rotator unit, and the fixing rotator unit is configured to be withdrawable from an apparatus main body of an image forming apparatus and to be such that the peripheral surface of the heating rotator is exposed when the fixing rotator unit is withdrawn from the apparatus main body, and wherein the fixing housing includes a feed guide constituting a part of a feed path above the heating rotator, the feed path feeding the transfer object that has passed through the fixing nip, and the feed guide is configured to be rotatable in a direction approaching the heating rotator through an operation performed by a user.

2. The fixing apparatus according to claim 1, wherein the fixing rotator unit is withdrawable in a direction orthogonal to an axial direction of the first rotational axis and the second rotational axis.

3. The fixing apparatus according to claim 2, further comprising an external heating mechanism configured to heat the heating rotator as the heat source, the external heating mechanism being disposed adjacent to or in contact with the peripheral surface of the heating rotator, at a position outside the heating rotator and opposite to the pressurizing rotator.

4. The fixing apparatus according to claim 3, wherein the external heating mechanism includes a biasing part configured to push and bias the external heating mechanism toward the heating rotator, wherein the biasing part is configured to apply a biasing force in a direction of withdrawal of the fixing rotator unit.

5. The fixing apparatus according to claim 4, wherein the apparatus main body includes a rail part configured to support the fixing rotator unit withdrawably, and the fixing rotator unit is configured to be detachable from the rail part at a position where the fixing rotator unit is withdrawn from the apparatus main body.

6. The fixing apparatus according to claim 3, wherein the apparatus main body includes a rail part configured to support the fixing rotator unit withdrawably, and the fixing rotator unit is configured to be detachable from the rail part at a position where the fixing rotator unit is withdrawn from the apparatus main body.

7. The fixing apparatus according to claim 2, wherein the apparatus main body includes a rail part configured to support the fixing rotator unit withdrawably, and the fixing rotator unit is configured to be detachable from the rail part at a position where the fixing rotator unit is withdrawn from the apparatus main body.

8. The fixing apparatus according to claim 1, wherein the fixing rotator unit further includes a separating member configured to remove the transfer object that has passed through the fixing nip away from the peripheral surface of the heating rotator, at a position adjacent to the fixing nip on a downstream side.

9. An image forming apparatus comprising: an image supporting unit having a surface on which an electrostatic latent image is formed;

a developing apparatus configured to develop a toner image for the electrostatic latent image formed on the image supporting unit;

an image transfer unit configured to directly or indirectly transfer the toner image formed on the image supporting unit to the transfer object; and the fixing apparatus according to claim 1.

* * * * *